US009658554B2

(12) United States Patent
Kinumatsu et al.

(10) Patent No.: US 9,658,554 B2
(45) Date of Patent: May 23, 2017

(54) METHOD OF PRODUCING TONER AND METHOD OF PRODUCING RESIN PARTICLE

(71) Applicant: CANON KABUSHIKI KAISHA, Tokyo (JP)

(72) Inventors: Tetsuya Kinumatsu, Mishima (JP); Kenji Aoki, Mishima (JP); Yusuke Kosaki, Susono (JP); Noritaka Toyoizumi, Mishima (JP); Shuntaro Watanabe, Hadano (JP); Takaaki Kaya, Suntou-gun (JP); Atsushi Tani, Suntou-gun (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/073,572

(22) Filed: Mar. 17, 2016

(65) Prior Publication Data

US 2016/0291494 A1 Oct. 6, 2016

(30) Foreign Application Priority Data

Mar. 30, 2015 (JP) ..... 2015-069137
Feb. 23, 2016 (JP) ..... 2016-031884

(51) Int. Cl.
*G03G 9/08* (2006.01)
*G03G 9/093* (2006.01)

(52) U.S. Cl.
CPC ..... *G03G 9/09392* (2013.01); *G03G 9/0804* (2013.01)

(58) Field of Classification Search
CPC ..... G03G 9/0804; G03G 9/08755
See application file for complete search history.

(56) References Cited

U.S. PATENT DOCUMENTS

| | | | | |
|---|---|---|---|---|
| 9,056,955 | B2 | 6/2015 | Mizumori et al. | |
| 9,176,410 | B2 | 11/2015 | Tani et al. | |
| 2013/0323637 | A1* | 12/2013 | Watanabe | G03G 9/0802 430/109.4 |

FOREIGN PATENT DOCUMENTS

| | | | |
|---|---|---|---|
| JP | 2006-91379 | A | 4/2006 |
| JP | 2009-52005 | A | 3/2009 |
| JP | 2010-132851 | A | 6/2010 |
| JP | 2010-116976 | A | 6/2011 |
| JP | 2011-246691 | A | 12/2011 |
| JP | 2012-118468 | A | 6/2012 |
| JP | 2013-137535 | A | 7/2013 |

* cited by examiner

*Primary Examiner* — Hoa V Le
(74) *Attorney, Agent, or Firm* — Fitzpatrick Cella Harper and Scinto

(57) ABSTRACT

A method of producing a toner containing a toner particle having a core-shell structure that has a core containing a resin and has a shell phase on a surface of the core, the shell phase being derived from a resin fine particle containing a resin A, and the resin A being a resin containing a segment derived from a crystalline polymer D, the method including steps (i), (ii) and (iii).

17 Claims, 1 Drawing Sheet

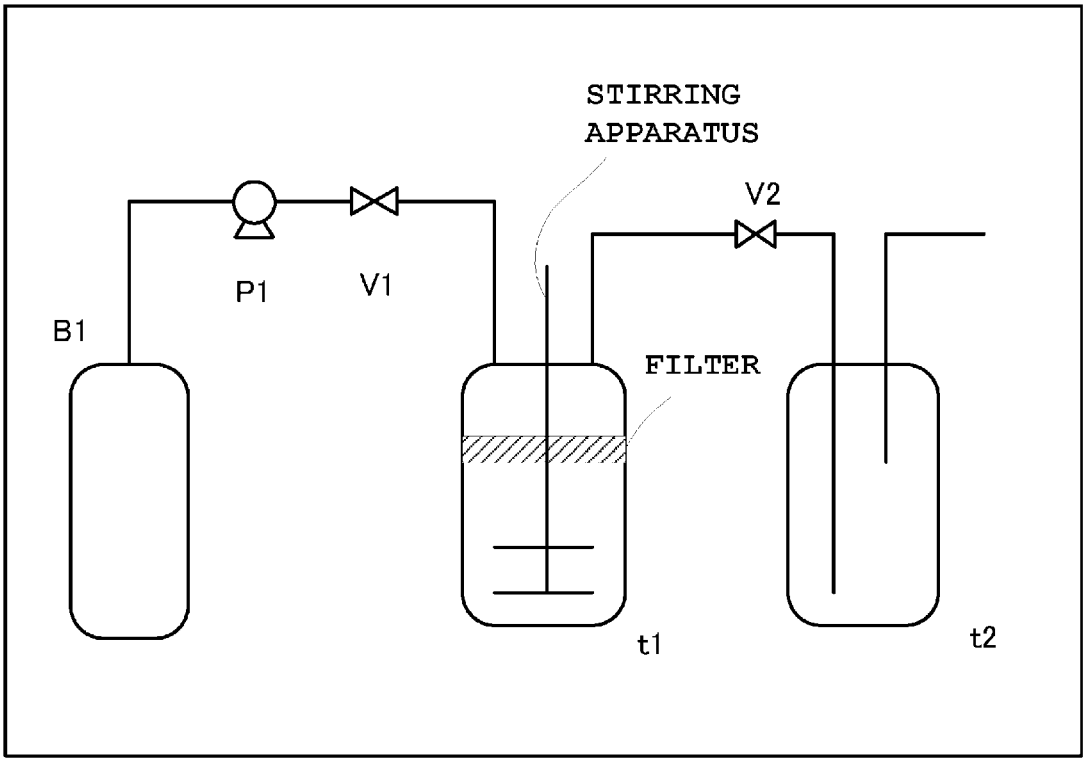
STIRRING
APPARATUS
V2
P1
V1
B1
FILTER
t1
t2

METHOD OF PRODUCING TONER AND METHOD OF PRODUCING RESIN PARTICLE

BACKGROUND OF THE INVENTION

Field of the Invention

The present invention relates to a method of producing a toner that is used in recording methods that utilize an electrophotographic procedure, an electrostatic recording procedure, or a toner jet recording procedure. The present invention also relates to a method of producing a resin particle.

Description of the Related Art

Resin particles are used in a broad range of fields as highly functional powders, and, in order to control their functionality, monodisperse resin particles having a narrow particle size distribution are frequently required. In the field of electrophotographic apparatuses in particular, there is unending demand for enhancing image quality, and uniform properties among the particles are thus required of the toner particles that form the image. It is effective in pursuing this to inhibit the generation of low-circularity irregular-shape particles together with providing a uniform toner particle diameter and a sharp particle size distribution.

The "dissolution suspension method" is known to be a production method that can readily achieve a sharpening of the particle size distribution and a higher circularity for toner particles. The dissolution suspension method is a method in which a resin solution is preliminarily prepared by dissolving a resin in an organic solvent, this resin solution is dispersed in a dispersion medium and a dispersion of droplets is formed by the resin solution, and particles are subsequently obtained by removing the organic solvent from the dispersion. An aqueous medium is generally used as the dispersion medium in the dissolution suspension method, but this approach requires very large amounts of energy and time for a washing step and drying step after the particles have been formed.

In Japanese Patent Application Laid-open No. 2009-052005, a method for producing resin particles by the dissolution suspension method is described that uses liquid-state or supercritical-state carbon dioxide as the dispersion medium. In this method, particles are obtained by introducing liquid or supercritical carbon dioxide after the formation of the dispersion of droplets with the resin solution and by carrying out solvent removal by extracting the organic solvent. With this method, the particles can be easily separated from the dispersion medium by depressurization following particle production and a low-energy production is made possible because a washing step and drying step are not required.

Japanese Patent Application Laid-open No. 2010-132851 describes a method in which resin particles having a core-shell structure are produced by a dissolution suspension method using carbon dioxide for the dispersion medium; here, resin fine particles resistant to swelling by carbon dioxide are used as a dispersant with the goal of preventing the droplets from aggregating and the shell is also formed by these resin fine particles.

In Japanese Patent Application Laid-open No. 2011-116976, a production method is described in which, in a dissolution suspension method using carbon dioxide for the dispersion medium, the solvent removal efficiency during solvent removal is raised by bring about the crystallization and solidification of a resin dissolved in the droplets.

In Japanese Patent Application Laid-open No. 2013-137535, a toner particle is described that uses a resin fine particle that contains a comb-structure resin for which the essential constituent components are a segment having an organopolysiloxane structure and a segment having an aliphatic polyester structure.

SUMMARY OF THE INVENTION

Fine particles from a crystalline polyester resin or polybehenyl acrylate or their copolymerized resin or from a crosslinked vinyl resin are used as the resin fine particles in Japanese Patent Application Laid-open No. 2010-132851.

However, when the present inventors carried out investigations in which a toner particle was produced based on this procedure, it was found that a toner particle with a sharp particle size distribution was not necessarily obtained when fine particles from the crystalline polyester resin or polybehenyl acrylate or their copolymerized resin were used. The cause for this is thought to be as follows: the crystalline polyester resin, polybehenyl acrylate, and their copolymerized resins had a low stability with regard to organic solvents and as a consequence had a low functionality as a resin fine particle-based dispersant and an adequate suppression of droplet coalescence did not then occur.

The present inventors carried out investigations into resin particle production in accordance with Japanese Patent Application Laid-open No. 2011-116976, using carbon dioxide for the dispersion medium and using a crystalline resin in both the resin that forms the main component of the resin particles and the fine particles that are fixed at the surface of these resin particles. The resin particles obtained as a result were not necessarily satisfactory with regard to their particle size distribution. The following interpretation is offered here.

In the step of forming droplets of the resin that will form the main component of the resin particles, the fine particles that will be fixed to the surface of these resin particles are dispersed in the carbon dioxide, which is the dispersion medium, and function as a dispersant that brings about stabilization by adsorbing to the droplet surface. However, in the investigations carried out at that time, under the conditions at which granulation was actually carried out the fine particles were unable to exist in a solid fine particle state and the droplet stability was impaired and it is thought that the particle size distribution was then lowered as a result.

A toner particle that exhibits a good particle size distribution is obtained in accordance with Japanese Patent Application Laid-open No. 2013-137535 because here the toner particle is produced by the dissolution suspension method using carbon dioxide for the dispersion medium and using a resin fine particle that exhibits affinity for both carbon dioxide and the resin solution.

However, it was thought that a toner particle with an even sharper particle size distribution would be obtained by carrying out droplet formation in a temperature range in which the resin solution had a lowered viscosity; however, when toner particle production was carried out at a higher temperature, contrary to expectations a toner particle with a good particle size distribution was not obtained. The cause of this is thought to be that the stability of the resin fine particles with respect to the organic solvent ended up being reduced in the higher temperature range and the functionality of the resin fine particles as a dispersant also ended up being reduced, and that as a consequence coalescence of the droplets was not satisfactorily suppressed.

Thus, the production method of producing, in a dispersion medium, a toner particle that uses a crystalline resin in the fine particles fixed to the toner particle surface still had a problem with regard to obtaining a sharp particle size distribution.

The present invention provides a toner production method and a resin particle production method that solve the existing problems that are described in the preceding.

That is, the present invention provides a toner production method and a resin particle production method that, using as the dispersant a resin fine particle that uses a crystalline resin, can conveniently and efficiently produce a toner particle or a resin particle that has a uniform shape and a sharp particle size distribution.

The present invention relates to a method of producing a toner containing a toner particle having a core-shell structure that has a core containing a resin and has a shell phase on a surface of the core, the shell phase being derived from a resin fine particle containing a resin A, and the resin A being a resin containing a segment derived from a crystalline polymer D, the method including the following steps (i) and (ii): (i) a step of preparing a dispersion in a container, the dispersion being a dispersion of a resin solution droplet dispersed in a dispersion medium, and the resin solution droplet containing the resin, the resin fine particle, and an organic solvent; and (ii) a step of extracting the organic solvent contained in the resin solution droplet into the dispersion medium and removing the organic solvent from the dispersion medium, wherein: an amount of matter soluble in the organic solvent at a temperature of 35° C. is not more than 30.0 mass % of the resin A, and an amount of matter soluble in the organic solvent at a temperature of 35° C. is at least 90.0 mass % of the crystalline polymer D, a gauge pressure P1 within the container during the preparation of the dispersion in the step (i) is not more than 8.0 MPa, the dispersion is maintained in the step (i) at a temperature higher than a temperature Ta (° C.), and the toner production method further includes the following step (iii) between the step (i) and the step (ii): (iii) a step of cooling the dispersion to a temperature lower than the temperature Ta (° C.), (where the temperature Ta (° C.) is a temperature at which—when a crystalline polymer solution prepared by dissolving the crystalline polymer D in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer D contained in the crystalline polymer solution is first observed; in addition, the mixing mass ratio between the crystalline polymer D and the organic solvent is the same as the mixing mass ratio in the step (i) between the crystalline polymer D contained in the resin fine particle and the organic solvent).

The present invention further relates to a method of producing a resin particle having a core-shell structure that has a core containing a resin and has a shell phase on a surface of the core, the shell phase being derived from a resin fine particle containing a resin A, and the resin A being a resin containing a segment derived from a crystalline polymer D, the method including the following steps (i) and (ii): (i) a step of preparing a dispersion in a container, the dispersion being a dispersion of a resin solution droplet dispersed in a dispersion medium, and the resin solution droplet containing the resin, the resin fine particle, and an organic solvent; and (ii) a step of extracting the organic solvent contained in the resin solution droplet into the dispersion medium and removing the organic solvent from the dispersion medium, wherein: an amount of matter soluble in the organic solvent at a temperature of 35° C. is not more than 30.0 mass % of the resin A, and an amount of matter soluble in the organic solvent at a temperature of 35° C. is at least 90.0 mass % of the crystalline polymer D, a gauge pressure P1 within the container during the preparation of the dispersion in the step (i) is not more than 8.0 MPa, the dispersion is maintained in the step (i) at a temperature higher than a temperature Ta (° C.), and the resin particle production method further includes the following step (iii) between the step (i) and the step (ii): (iii) a step of cooling the dispersion to a temperature lower than the temperature Ta (° C.) (where the temperature Ta (° C.) is a temperature at which—when a crystalline polymer solution prepared by dissolving the crystalline polymer D in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer D contained in the crystalline polymer solution is first observed; in addition, the mixing mass ratio between the crystalline polymer D and the organic solvent is the same as the mixing mass ratio in the step (i) between the crystalline polymer D contained in the resin fine particle and the organic solvent).

Further features of the present invention will become apparent from the following description of exemplary embodiments (with reference to the attached drawings).

BRIEF DESCRIPTION OF THE DRAWINGS

The FIGURE is a schematic diagram of an example of a resin particle production apparatus for the production method of the present invention. In the FIG. B1 is a compressed gas cylinder, P1 is a pump, V1 is a first valve, V2 is a second valved, t1 is a granulation tank, and t2 is a solvent recovery tank.

DESCRIPTION OF THE EMBODIMENTS

A more detailed description is provided below using embodiments of the present invention, but there is no limitation to these.

The toner (or resin particle) production method of the present invention (also referred to herebelow simply as the production method of the present invention) is a production method that proceeds through a dissolution suspension method that uses, as a dispersant, a resin fine particle that contains a resin A that contains a segment derived from a crystalline polymer D.

This crystalline polymer D exhibits a clear melting point peak in differential scanning calorimetric measurement using a differential scanning calorimeter (DSC); undergoes almost no softening up to temperatures below the melting point; and, when a temperature higher than the melting point is assumed, undergoes melting and abruptly softens.

In addition, when a solution provided by dissolving the crystalline polymer D in an organic solvent is cooled, the soluble matter of the resin abruptly crystallizes and precipitates once a certain temperature is reached.

When a toner (or resin particle) is produced by a dissolution suspension method that uses a finely particulate solid dispersant, a coalescence-inhibiting effect on the droplets can generally be expected depending on the particle diameter of the fine particles. However, various types of control are necessary in order to bring about a segregation of the solid dispersant to the droplet surface, and it becomes necessary, for example, to bond, on the surface of the solid dispersant, both functional groups that have an affinity for the droplet and functional groups that have an affinity for the dispersion medium.

In addition, when a toner (or resin particle) is produced by a dissolution suspension method that uses a liquid dispersant that exhibits solubility in the dispersion medium, e.g., a surfactant, an increase in the dispersion stability of the droplets can be expected through the adsorption of the liquid dispersant to the droplet surface. However, a large repulsion activity against droplet-to-droplet collisions is required and it then becomes necessary to raise the molecular weight and/or to utilize electrostatic repulsion.

By using as the dispersant a resin fine particle that contains the resin A that contains a segment derived from the crystalline polymer D, the present inventors thought to make possible a toner production that exploited the properties of both solid dispersants and liquid dispersants.

It is crucial for this that a temperature interval exist in which the crystalline polymer D, taken by itself, exhibits solubility in the organic solvent while the resin fine particle resists dissolution.

That is, the high absorbability of liquid dispersants is exhibited by forming the droplets in a temperature interval in which solubility is exhibited by the crystalline polymer D taken by itself. In addition, the droplet coalescence-inhibiting effect characteristic of solid dispersants is exhibited by carrying out solvent removal in a temperature interval in which the crystalline polymer D taken by itself undergoes crystallization. The present invention was reached based on the discovery that, by achieving the preceding, a resin particle having a uniform shape and a sharper particle size distribution than heretofore is conveniently and efficiently obtained.

The production method of the present invention is thus a method of producing a toner containing a toner particle having a core-shell structure that has a core containing a resin and has a shell phase on a surface of the core, the shell phase being derived from a resin fine particle containing a resin A, and the resin A being a resin containing a segment derived from a crystalline polymer D, the method including the following steps (i) and (ii): (i) a step of preparing a dispersion in a container, the dispersion being a dispersion of resin solution droplets dispersed in a dispersion medium, and the resin solution droplets containing the resin, the resin fine particle, and an organic solvent; and (ii) a step of extracting the organic solvent contained in the resin solution droplets into the dispersion medium and removing the organic solvent from the dispersion medium, wherein: an amount of matter soluble in the organic solvent at a temperature of 35° C. is not more than 30.0 mass % of the resin A, and an amount of matter soluble in the organic solvent at a temperature of 35° C. is at least 90.0 mass % of the crystalline polymer D, the gauge pressure P1 within the container during the preparation of the dispersion in step (i) is not more than 8.0 MPa, the dispersion is maintained in step (i) at a temperature higher than a temperature Ta (° C.), and the toner production method further includes the following step (iii) between step (i) and step (ii): (iii) a step of cooling the dispersion to a temperature lower than the temperature Ta (° C.) [where the temperature Ta (° C.) is a temperature at which—when a crystalline polymer solution prepared by dissolving the crystalline polymer D in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer D contained in the crystalline polymer solution is first observed; in addition, the mixing mass ratio between the crystalline polymer D and the organic solvent is the same as the mixing mass ratio in step (i) between the crystalline polymer D contained in the resin fine particle and the organic solvent].

In the production method of the present invention, at least 90.0 mass % of the crystalline polymer D is matter soluble in the organic solvent at a temperature of 35° C. At 90.0 mass % and above, affinity for the resin solution droplets is present and the resin fine particles segregate in step (i) such that they coat the droplet surface, thereby providing an excellent dispersibility for the droplets. At less than 90.0 mass %, the ability of the resin fine particles to adsorb to the droplet surface is reduced. As a result, droplet coalescence occurs and coarse particles then occur in large amounts. In addition, problems with the production apparatus are produced due to the formation of aggregates by free resin fine particles.

Apparatuses that produce resin particles using carbon dioxide as the dispersion medium may have a recovery filter disposed in the apparatus. The aggregates of fine particles having a size of several hundred nanometers have a poor flowability and are trapped by the filter, leading to clogging. The occurrence of this clogging causes unstable production, for example, transport delays, more complicated cleaning, and so forth.

Matter soluble in the organic solvent at a temperature of 35° C. is preferably at least 95.0 mass % of crystalline polymer D.

The amount of matter in crystalline polymer D that is soluble in the organic solvent at a temperature of 35° C. can be controlled by adjusting the molecular weight of crystalline polymer D and adjusting its melting point through selection of the polymer composition.

The weight-average molecular weight (Mw) of the crystalline polymer D in the present invention is preferably at least 10,000 and not more than 50,000 and is more preferably at least 15,000 and not more than 40,000. The number-average molecular weight (Mn) of the crystalline polymer D is preferably at least 2,000 and not more than 40,000 and is more preferably at least 3,000 and not more than 30,000.

The melting point of crystalline polymer D is preferably at least 45.0° C. and not more than 120.0° C. and is more preferably at least 50.0° C. and not more than 100.0° C.

The content of the crystalline polymer D is preferably at least 10.0 mass parts and not more than 50.0 mass parts per 100.0 mass parts of the resin A.

Matter soluble in the organic solvent at a temperature of 35° C. is not more than 30.0 mass % of the resin A in the production method of the present invention. At 30.0 mass % and below, the majority can exist in a solid state even in the organic solvent and an inhibition of droplet coalescence is then made possible. When 30.0 mass % is exceeded, it is thought that the amount of the resin fine particle that does not function as a solid dispersant then becomes prominent. The result of this is that droplet coalescence ends up being produced and coarse particles are produced in large numbers.

In addition, the aggregation of resin fine particles with each other is facilitated in this case and problems with the production apparatus are then produced. Specifically, transport of a dispersion of the resin fine particles in organic solvent or dispersion medium occurs frequently in an apparatus for producing toner (or resin particles). Clogging by aggregates of the resin fine particles is produced here when a narrow section is present along the piping or at an input or output feature, or when a filter for removing foreign material is present.

Matter soluble in the organic solvent at a temperature of 35° C. is preferably not more than 25.0 mass % of the resin A.

The amount of matter in the resin A that is soluble in the organic solvent at a temperature of 35° C. can be controlled by adjusting the molecular weight of the resin A and adjusting the crosslink density through the introduction of a crosslink structure.

The crosslink density for the resin A is described below.

The dispersion medium in the production method of the present invention is a medium that does not dissolve the resin and does not dissolve the resin fine particle and that is immiscible with the resin solution, and a medium capable of undergoing liquefaction can be used. The dispersion medium can be exemplified as follows.

Hydrophobic dispersion media can be exemplified by carbon dioxide; hydrocarbon solvents such as pentane, hexane, heptane, octane, decane, hexadecane, and cyclohexane; and silicone solvents such as polydimethylsiloxane.

Hydrophilic dispersion media can be exemplified by water and by alcohol solvents such as methanol, ethanol, propanol, and butanol.

A carbon dioxide-containing dispersion medium is preferred for the present invention.

Carbon dioxide may be used by itself for the dispersion medium or may contain an organic solvent as an additional component. When the carbon dioxide additionally contains an organic solvent, the carbon dioxide and the organic solvent preferably form a homogeneous phase. The organic solvent is preferably incorporated at level that does not dissolve the resin and does not dissolve the resin fine particle, and the carbon dioxide content is preferably at least 50 mass % of the dispersion medium as a whole and is more preferably at least 70 mass %.

The additional component here can be exemplified by the following:

hydrocarbon solvents such as pentane, hexane, heptane, octane, decane, hexadecane, and cyclohexane; silicone solvents such as polydimethylsiloxane;

ketone solvents such as acetone, methyl ethyl ketone, methyl isobutyl ketone, and di-n-butyl ketone; ester solvents such as ethyl acetate, butyl acetate, and methoxybutyl acetate; ether solvents such as tetrahydrofuran, diethyl ether, dioxane, ethyl cellosolve, and butyl cellosolve; amide solvents such as dimethylformamide and dimethylacetamide; aromatic hydrocarbon solvents such as toluene, xylene, and ethylbenzene; and water.

When a dispersion medium that assumes the liquid state at atmospheric pressure is used for the dispersion medium, production of the dispersion can be carried out at atmospheric pressure (approximately 0.1013 MPa).

In addition, when a carbon dioxide-containing dispersion medium is used as the dispersion medium, separation of the toner (or resin particle) from the carbon dioxide-containing dispersion medium can then be carried out rapidly and conveniently to obtain the toner (or resin particle).

The gauge pressure P1 within the container during the preparation of the dispersion in step (i) in the production method of the present invention is not more than 8.0 MPa.

While preparation of the dispersion may be carried out at atmospheric pressure, it is preferably carried out at a gauge pressure P1 of at least 1.0 MPa and not more than 8.0 MPa when a carbon dioxide-containing dispersion medium is used for the dispersion medium. Setting this gauge pressure P1 to at least 1.0 MPa and not more than 8.0 MPa when a carbon dioxide-containing dispersion medium is used as the dispersion medium makes it possible to prepare a dispersion having a well-regulated droplet diameter. At 1.0 MPa and above, the amount of dispersion medium required for droplet formation is at a moderate level and the dispersion is easily prepared.

When, on the other hand, 8.0 MPa is exceeded, the organic solvent in the droplets then readily transfers into the dispersion medium and the droplet viscosity rises. As a result, shear is not uniformly applied during granulation and there is a risk that the particle size distribution will become broad. The gauge pressure P1 is preferably at least 1.5 MPa and not more than 5.0 MPa.

The temperature Ta (° C.) in the production method of the present invention is the temperature at which—when a crystalline polymer solution prepared by dissolving the crystalline polymer D in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer D contained in the crystalline polymer solution is first observed.

In addition, the mixing mass ratio between the crystalline polymer D and the organic solvent is the same as the mixing mass ratio in step (i) between the crystalline polymer D contained in the resin fine particle and the organic solvent. The organic solvent here is the same as the organic solvent used in step (i). In addition, the ramp down rate during cooling in this measurement of the temperature Ta (° C.) is preferably the same as the ramp down rate when the dispersion is cooled in step (iii) to a temperature lower than the temperature Ta (° C.).

The temperature Tb (° C.), which is the temperature at which heat generation accompanying the crystal precipitation of the crystalline polymer E is first observed, is also measured by the same method, vide infra.

The dispersion is maintained in step (i) in the production method of the present invention at a temperature higher than the temperature Ta (° C.). By dispersing the droplets at a temperature higher than Ta (° C.), a state is assumed in which the segment derived from the crystalline polymer D exhibits a high molecular mobility and the resin fine particles can then adsorb and segregate to the droplet surface. As a result, the droplets can be stably dispersed and resin particles with a sharp particle size distribution can be obtained.

When the temperature of the dispersion in step (i) drops down to a temperature equal to or less than Ta (° C.), the segment derived from the crystalline polymer D undergoes crystallization, and as a consequence the ability of the resin fine particles to segregate to the droplet surface is reduced and the amount of dispersant in a free state not adsorbed to the droplet becomes substantial. As a result, the dispersion stability of the droplets is impaired; the amount of coarse powder in the ultimately obtained toner (or resin particle) is increased; and the particle size distribution is broadened.

In addition, capture of the resin fine particles in the piping and filters is produced due to aggregates formed from among the free resin fine particles and the potential during production for clogging of the piping and filter clogging is increased. The occurrence of this clogging causes production to be unstable, e.g., transport delays, more complicated cleaning, and so forth.

Viewed from the standpoint of the ease of temperature management during production, the dispersion is preferably maintained in step (i) at a temperature equal to or greater than the temperature Ta+3 (° C.).

The production method of the present invention additionally has, between the step (i) and the step (ii), a step (iii) of cooling the dispersion to a temperature lower than the temperature Ta (° C.).

Cooling is carried out after the preparation of a stable dispersion in the step (i), and the resin fine particles present at the droplet surface become hard due to the cooling to a temperature lower than the temperature at which the segment derived from the crystalline polymer D crystallizes.

As a result, coalescence due to droplet collision can be inhibited because the droplet surface is covered by a robust layer, and the production of coarse powder can then be suppressed.

When the cooling temperature in step (iii) is equal to or greater than Ta (° C.), the crystalline polymer D does not undergo crystallization and the resin fine particle also assumes a soft and pliable state. The transition to step (ii) then occurs in this state, and as a result liquid droplet coalescence is readily produced during extraction of the organic solvent from the droplets. A means for suppressing this coalescence is to apply a shear force that is at least as large as that in step (i), but in such a case an excess shear force will be applied to some of the droplets and the potential for the production of fines is effectively increased. Viewed from the perspective of the ease of temperature management during production, cooling is preferably carried out in step (iii) to a temperature that is equal to or lower than the temperature Ta-3 (° C.).

In addition, cooling is desirably carried out at the gauge pressure P1 in this cooling step. Moreover, viewed from the perspective of the ease of temperature management during production, the ramp down rate for the dispersion in this cooling step is preferably at least 0.2° C./min and not more than 20.0° C./min and more preferably at least 0.5° C./min and not more than 5.0° C./min.

The production method of the present invention has a step (ii) in which the organic solvent in the droplets is extracted into the dispersion medium and the organic solvent is also removed from the dispersion medium, i.e., a solvent removal step.

The gauge pressure P2 (MPa) within the container in this step (ii) is preferably adjusted to a gauge pressure P2 that satisfies the relationship P1≤P2.

This is preferably carried out while the resin particles that are formed are captured with, for example, a filter. By having the gauge pressure P2 be equal to or greater than the gauge pressure P1, the density of the dispersion medium is increased and the dispersion medium can be efficiently discharged from the container.

A step of deliberately lowering the pressure must be executed when P2 is lower than P1, and having P2 be a pressure equal to or greater than P1 is thus preferred from a manufacturing standpoint.

The resin A in the production method of the present invention is a resin that contains a segment derived from the crystalline polymer D.

This crystalline polymer D can be exemplified by crystalline polyesters, crystalline vinyl polymers, crystalline polyurethanes, and crystalline polyureas. Crystalline polyesters and crystalline vinyl polymers are preferred, and crystalline polyesters are particularly preferred.

This crystalline polyester is preferably obtained by the reaction of an aliphatic diol with an aliphatic dicarboxylic acid. It is more preferably obtained by the reaction of a $C_{2-20}$ aliphatic diol and a $C_{2-20}$ aliphatic dicarboxylic acid.

In addition, the aliphatic diol is preferably a linear chain type. A polyester having a higher crystallinity is obtained by the use of a linear chain type.

The linear chain $C_{2-20}$ aliphatic diols can be exemplified by the following compounds: 1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

The following are more preferred among the preceding from the standpoint of the melting point: 1,4-butanediol, 1,5-pentanediol, 1,6-hexanediol, 1,7-heptanediol, 1,8-octanediol, 1,9-nonanediol, and 1,10-decanediol. A single one of these may be used by itself or a mixture of two or more may be used.

A double bond-bearing aliphatic diol may also be used. This double bond-bearing aliphatic diol can be exemplified by the following compounds:

2-butene-1,4-diol, 3-hexene-1,6-diol, and 4-octene-1,8-diol.

The aliphatic dicarboxylic acid is preferably a linear chain aliphatic dicarboxylic acid from the standpoint of the crystallinity.

The linear chain $C_{2-20}$ aliphatic dicarboxylic acids can be exemplified by the following compounds: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. The lower alkyl esters and anhydrides of these aliphatic dicarboxylic acids can also be used.

Among the preceding, sebacic acid, adipic acid, and 1,10-decanedicarboxylic acid and their lower alkyl esters and anhydrides are preferred. A single one of these may be used by itself or a mixture of two or more may be used.

Aromatic carboxylic acids can also be used. The aromatic dicarboxylic acids can be exemplified by the following compounds: terephthalic acid, isophthalic acid, 2,6-naphthalenedicarboxylic acid, and 4,4'-biphenyldicarboxylic acid.

Among the preceding, terephthalic acid is preferred from the standpoint of the ease of acquisition and because it readily forms a low melting point polymer.

A double bond-bearing dicarboxylic acid may also be used. In view of the fact that the resin as a whole can be crosslinked utilizing this double bond, the use of a double bond-bearing dicarboxylic acid is advantageous for preventing hot offset during fixing.

Such a dicarboxylic acid can be exemplified by fumaric acid, maleic acid, 3-hexenedioic acid, and 3-octenedioic acid. Their lower alkyl esters and anhydrides are also included as examples. Among the preceding, fumaric acid and maleic acid are more preferred from a cost standpoint.

There are no particular limitations on the method of producing this crystalline polyester, and it can be produced by general polyester polymerization methods in which a dicarboxylic acid component and a diol component are reacted. For example, production may be carried out by selecting a direct polycondensation method or a transesterification method as appropriate depending on the species of monomer.

The production of this crystalline polyester is preferably carried out a polymerization temperature of from 180° C. to 230° C., and the reaction is preferably run while removing the water and/or alcohol produced during condensation, as necessary with a reduction in pressure in the reaction system.

Catalysts that can be used in the production of this crystalline polyester can be exemplified by the following compounds: titanium catalysts such as titanium tetraethoxide, titanium tetrapropoxide, titanium tetraisopropoxide, and titanium tetrabutoxide, and tin catalysts such as dibutyltin dichloride, dibutyltin oxide, and diphenyltin oxide.

The crystalline vinyl polymers can be exemplified by resins provided by the polymerization of vinylic monomer containing a linear chain type alkyl group in its molecular structure.

This vinylic monomer containing a linear chain type alkyl group in its molecular structure is preferably an alkyl acrylate or alkyl methacrylate in which the number of carbons in the alkyl group is at least 12 and can be exemplified by the following: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, and behenyl methacrylate.

Polymerization at a temperature of at least 40° C. and generally at least 50° C. and not more than 90° C. is preferred for the method of producing the crystalline vinyl polymer.

The crystalline polymer D in the production method of the present invention is preferably a crystalline polyester a1 having polymerizable unsaturated group.

The average number of polymerizable unsaturated groups per molecule of this crystalline polyester a1 is preferably at least 1.0 and not more than 3.0.

This average number of polymerizable unsaturated groups represents the degree of unsaturation of the crystalline polyester a1. By having this average number of polymerizable unsaturated groups be in the indicated range, the crosslink density in resin A can then be adjusted to enable a favorable control of the amount of matter in resin A that is soluble in the organic solvent at a temperature of 35° C.

When this average number of polymerizable unsaturated groups is at least 1.0, a crosslinked structure can then be readily assumed by the crystalline polyester a1 and a trend of increasing stability to organic solvent is exhibited. In addition, the matter in resin A soluble in the organic solvent at a temperature of 35° C. is also readily controlled to not more than 30.0 mass %.

As a consequence, an excessive increase in the softness and pliability of the resin fine particles is inhibited also after the crystallization of the resin A and a trend is set up in the direction of suppression of droplet coalescence.

Moreover, the proportion of crystalline polymer D not chemically bonded to the resin A is appropriately controlled, which facilitates inhibition of its elution from the resin fine particle into the dispersion medium and droplet. The particle size distribution tends to become sharp as a result.

When, on the other hand, the average number of polymerizable unsaturated groups is not more than 3.0, the crosslink density due to the crystalline polymer al is then not too large. As a result, the adhesiveness to the droplet by the resin fine particles that originates with the segment derived from the crystalline polymer D is improved. This results in an excellent ability by the resin fine particles to coat the droplet. In addition, the occurrence of clogging of the filters and piping by aggregates of the free resin fine particles is suppressed. Moreover, the degree of freedom of the crystalline polymer D-derived segment itself is increased and a crystalline structure may then be more easily assumed. As a result, the resin fine particle undergoes solidification upon cooling and droplet coalescence is then inhibited and the production of coarse powder is suppressed.

The crystalline polyester a1 more preferably has an average number of polymerizable unsaturated groups per molecule of at least 1.4 and not more than 2.6.

The method for producing the crystalline polyester a1 can be exemplified by the following.

(1) Methods in which the polymerizable unsaturated group is introduced at the time of the polycondensation reaction between the dicarboxylic acid and diol. Methods for introducing this polymerizable unsaturated group can be exemplified by the following procedures.

(1-1) The method of using a polymerizable unsaturated group-bearing dicarboxylic acid for a portion of the dicarboxylic acid.

(1-2) The method of using a polymerizable unsaturated group-bearing diol for a portion of the diol.

(1-3) The method of using a polymerizable unsaturated group-bearing dicarboxylic acid and a polymerizable unsaturated group-bearing diol for, respectively, a portion of the dicarboxylic acid and a portion of the diol.

The degree of unsaturation of the crystalline polyester a1 can be adjusted through the amount of addition of the polymerizable unsaturated group-bearing dicarboxylic acid or diol.

The polymerizable unsaturated group-bearing dicarboxylic acid can be exemplified by fumaric acid, maleic acid, 3-hexenedioic acid, and 3-octenedioic acid. Additional examples are the lower alkyl esters and anhydrides of the preceding. Viewed from the standpoint of cost, fumaric acid and maleic acid are more preferred among the preceding. The polymerizable unsaturated group-bearing aliphatic diol can be exemplified by the following compounds: 2-butene-1,4-diol, 3-hexene-1,6-diol, and 4-octene-1,8-diol.

(2) Methods in which a vinylic compound is coupled with a polyester itself prepared by the polycondensation of dicarboxylic acid and diol.

This coupling may be a direct coupling of a vinylic compound that contains a functional group capable of reacting with a terminal functional group on the polyester. In addition, coupling may be carried out after the polyester terminal has been modified using a linker so as to enable reaction with a functional group carried by the vinylic compound. The following methods are examples.

(2-1) The method of carrying out a condensation reaction between a polyester having the carboxyl group in terminal position and a hydroxyl group-bearing vinylic compound.

In this case, the molar ratio between the dicarboxylic acid and diol (dicarboxylic acid/diol) in the preparation of the polyester is preferably at least 1.02 and not more than 1.20.

(2-2) The method of carrying out a urethanation reaction between a polyester having the hydroxyl group in terminal position and an isocyanate group-bearing vinylic compound.

(2-3) The method of carrying out a urethanation reaction of a polyester having the hydroxyl group in terminal position and a hydroxyl group-bearing vinylic compound with a diisocyanate functioning as a linker.

The molar ratio between the diol and the dicarboxylic acid (diol/dicarboxylic acid) in the preparation of the polyester used in methods (2-2) and (2-3) is preferably at least 1.02 and not more than 1.20.

The hydroxyl group-bearing vinylic compound can be exemplified by hydroxystyrene, N-(hydroxymethyl) acrylamide, N-(hydroxymethyl)methacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether. Hydroxyethyl acrylate and hydroxyethyl methacrylate are preferred among the preceding.

The isocyanate group-bearing vinylic compound can be exemplified by the following: 2-isocyanatoethyl acrylate, 2-isocyanatoethyl methacrylate, 2-(O-[1'-methylpropylideneamino]carboxyamino)ethyl methacrylate, 2-[(3,5-dimethylpyrazolyl)carbonylamino]ethyl methacrylate, and m-isopropenyl-α,α-dimethylbenzyl isocyanate. 2-isocyanatoethyl acrylate and 2-isocyanatoethyl methacrylate are particularly preferred among the preceding.

The diisocyanate can be exemplified by the following: aliphatic diisocyanates that have at least 2 and not more than 18 carbons (excluding the carbons in the NCO groups; this also applies in the following), alicyclic diisocyanates that have at least 4 and not more than 15 carbons, aromatic diisocyanates that have at least 6 and not more than 20 carbons, and modifications of these diisocyanates (modifications containing the urethane group, carbodiimide group, allophanate group, urea group, biuret group, uretdione group, uretonimine group, isocyanurate group, or oxazolidone group; also referred to hereafter as modified diisocyanates).

The aromatic diisocyanates can be exemplified by the following: m- and/or p-xylylene diisocyanate (XDI) and α,α,α',α'-tetramethylxylylene diisocyanate.

The aliphatic diisocyanates can be exemplified by the following: ethylene diisocyanate, tetramethylene diisocyanate, hexamethylene diisocyanate (HDI), and dodecamethylene diisocyanate.

The alicyclic diisocyanates can be exemplified by the following: isophorone diisocyanate (IPDI), dicyclohexylmethane-4,4'-diisocyanate, cyclohexylene diisocyanate, and methylcyclohexylene diisocyanate.

XDI, HDI, and IPDI are preferred among the preceding.

The resin A preferably additionally contains a segment derived from a crystalline polymer E in the production method of the present invention.

This crystalline polymer E can be selected from the polymers usable as the crystalline polymer D. In particular, this crystalline polymer E is preferably a crystalline polyester b1 having polymerizable unsaturated group and can be selected from among those usable as the crystalline polyester a1 having polymerizable unsaturated group.

An amount of matter soluble in the organic solvent at a temperature of 35° C. is preferably at least 90.0 mass % of the crystalline polymer E in the production method of the present invention.

Moreover, Tb preferably satisfies the relationship Tb<Ta where Tb (° C.) is the temperature at which—when a crystalline polymer solution prepared by dissolving the crystalline polymer E in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer E contained in the crystalline polymer solution is first observed, and when the dispersion is cooled in step (iii) to a temperature lower than the temperature Ta (° C.), this dispersion temperature is preferably higher than the temperature Tb (° C.).

Affinity for the resin solution droplet by the resin fine particles can be maintained even after the step (iii) by having the matter soluble in the organic solvent at a temperature of 35° C. be at least 90.0 mass % of the crystalline polymer E and having the temperature of the dispersion post-cooling in step (iii) be higher than Tb (° C.).

In addition, the resin fine particles segregate to the droplet surface in step (ii) and a more stable solvent removal is made possible.

The ability of the resin fine particles to adsorb to the droplet surface is still further improved by having the soluble matter be at least 90.0 mass % and having the temperature of the dispersion post-cooling in step (iii) be higher than Tb (° C.). As a result, the inhibition of droplet coalescence is facilitated and a suppression of the amount of coarse particles is then supported.

The amount of matter soluble in the organic solvent at a temperature of 35° C. is more preferably at least 95.0 mass % of the crystalline polymer E.

The temperature of the dispersion post-cooling in step (iii) is preferably a temperature equal to or greater than Tb+3 (° C.).

The weight-average molecular weight (Mw) of the crystalline polymer E in the present invention is preferably at least 10,000 and not more than 50,000 and is more preferably at least 15,000 and not more than 40,000. The number-average molecular weight (Mn) of the crystalline polymer E is preferably at least 2,000 and not more than 40,000 and is more preferably at least 3,000 and not more than 30,000.

The melting point of the crystalline polymer E is preferably at least 45.0° C. and not more than 120.0° C. and is more preferably at least 50.0° C. and not more than 100.0° C.

The content of the crystalline polymer E is preferably at least 2.0 mass parts and not more than 30.0 mass parts per 100.0 mass parts of resin A.

In addition, the total in the resin A of the mass parts of the segment derived from the crystalline polymer D and the segment derived from the crystalline polymer E is preferably at least 20.0 mass parts and not more than 60.0 mass parts per 100.0 mass parts of the resin A.

The average number of polymerizable unsaturated groups per molecule of this crystalline polyester b1 is preferably at least 1.0 and not more than 3.0 in the production method of the present invention.

When this average number of polymerizable unsaturated groups is at least 1.0, stability versus the organic solvent is obtained. In addition, the proportion of crystalline polymer E not chemically bonded to the resin A is then not too large and the potential for elution from the resin fine particle into the dispersion medium and droplet is restrained and the manifestation of the functionality as a dispersant is facilitated. A sharper particle size distribution is supported as a result.

When, on the other hand, the average number of polymerizable unsaturated groups is not more than 3.0, the crosslink density due to the crystalline polymer b1 is then not too large. As a result, the adhesiveness to the droplet by the resin fine particles that originates with the segment derived from the crystalline polymer E is improved. This results in an excellent ability by the resin fine particles to coat the droplet and facilitates an inhibition of an increase in the coarse powder and thereby supports a sharper particle size distribution. In addition, the occurrence of clogging of the filters and piping by aggregates of the free resin fine particles is suppressed.

The resin A in the production method of the present invention preferably contains a polymer of a monomer composition that contains an organopolysiloxane compound.

In addition, this resin A preferably is a resin that contains a segment having the organopolysiloxane structure represented by the following formula (A) in side chain position.

formula (A)

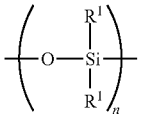

An organopolysiloxane structure is a structure in which the Si—O bond is a repeat unit and two alkyl groups are bonded to this Si. $R^1$ in the formula represents an alkyl group. The number of carbons in the alkyl group is preferably at least 1 and not more than 3 for each, and the number of carbons in $R^1$ is more preferably 1. In addition, n is the degree of polymerization and is preferably an integer with a value of at least 2.

This organopolysiloxane structure has a low interfacial tension and is hydrophobic, and as a consequence adsorbs to the resin droplet surface during granulation in a hydrophobic medium and thus facilitates an increase in the dispersion stability. The flexibility of a segment having an organopolysiloxane structure is higher for a structure in which only a single terminal is bonded than for a structure in which both terminals are bonded. Accordingly, a molecular structure that has a side-chain structure bonded at only a single terminal is preferably used.

The resin A in the production method of the present invention preferably contains a resin obtained by the polymerization of a monomer composition that contains a vinylic monomer that has the organopolysiloxane structure given by formula (A) above and also the substructure given by the following formula (B). The resin A more preferably contains a resin (polymer) obtained by the polymerization of a monomer composition that contains a compound given by the following formula (C) (a vinylic monomer that contains an organopolysiloxane structure).

formula (B)

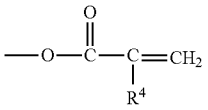

[$R^4$ in formula (B) represents a hydrogen atom or methyl group.]

formula (C)

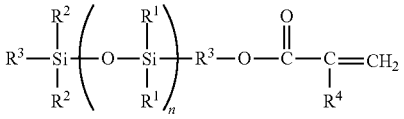

In formula (C), $R^1$ and $R^2$ each independently represent an alkyl group; $R^3$ represents an alkylene group; and $R^4$ is hydrogen atom or a methyl group. $R^1$ and $R^2$ preferably are each independently a $C_{1-3}$ alkyl group and $R^3$ is preferably a $C_{1-3}$ alkylene group. The number of carbons in $R^1$ is more preferably 1. n is the degree of polymerization and is preferably an integer at least 2 and not more than 133 and is more preferably an integer at least 2 and not more than 18.

The weight-average molecular weight (Mw) of this vinylic monomer having an organopolysiloxane structure is preferably at least 400 and not more than 2,000 in the production method of the present invention and is more preferably at least 400 and not more than 1,200.

Here, the weight-average molecular weight (Mw) of this vinylic monomer having an organopolysiloxane structure represents the length of this side chain. By having the value of this Mw be in the indicated range, the dispersion stability of the droplets is enhanced and the particle size distribution of the resin particles is made sharper and the circularity of the resin particles is raised.

The content of the segment having the organopolysiloxane structure is preferably at least 5.0 mass parts and not more than 40.0 mass parts per 100.0 mass parts of the resin A.

The resin A in the production method of the present invention preferably is a resin having a crosslink structure.

The introduction of a crosslink structure may be carried out using the crystalline polyester having polymerizable unsaturated group, or may be carried out using a polyfunctional monomer as described in the following, or may be carried out using both of these in combination. This polyfunctional monomer denotes a monomer that has a plurality of polymerizable unsaturated groups.

A vinylic polyfunctional monomer is preferred when the crosslink structure is introduced through the use of a polyfunctional monomer. The vinylic polyfunctional monomer can be exemplified by at least one polyfunctional monomer selected from the group consisting of difunctional monomers: polyethylene glycol diacrylate, polypropylene glycol diacrylate, polytetramethylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate, 1,6-hexanediol dimethacrylate, neopentyl glycol dimethacrylate, divinylbenzene, divinylnaphthalene, silicone that has undergone acrylic modification at both terminals, and silicone that has undergone methacrylic modification at both terminals; trifunctional monomers: trimethylolpropane triacrylate and trimethylolpropane trimethacrylate; and tetrafunctional monomers: tetramethylolmethane tetraacrylate and tetramethylolmethane tetramethacrylate.

Difunctional monomers are preferred among the preceding. An example of a more preferred difunctional monomer is the difunctional monomer given by the following formula (D).

formula (D)

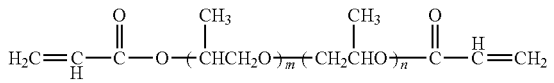

Here, m and n are the degrees of polymerization and are each preferably an integer at least 1 and not more than 10. In addition, m+n is preferably an integer at least 2 and not more than 16.

The crosslink density in the resin A depends on the degree of unsaturation of the polyfunctional monomer used, the molecular weight of the polyfunctional monomer, and the number of moles of polyfunctional monomer used relative to the total number of moles of monomer or polymer that forms the resin A.

For example, the polyfunctional monomer is preferably present at not more than 10.0 mol % with respect to the total number of moles of the monomer or polymer used in the polymerization of the resin A.

In addition, in order to favorably control the crosslink density at a number of parts of the polyfunctional monomer in a range that does not exercise an effect on the composition of the monomers other than the polyfunctional monomer, the weight-average molecular weight (Mw) of the polyfunctional monomer is preferably at least 200 and not more than 2,000 and is more preferably at least 300 and not more than 1,500.

The resin A in the production method of the present invention preferably is a resin obtained by the polymerization of the crystalline polyester a1 having polymerizable unsaturated group and at least one compound selected from the group consisting of the crystalline polyester b1 having polymerizable unsaturated group, the organopolysiloxane compound, and polyfunctional monomer.

More preferably, it is a resin provided by the polymerization of the crystalline polyester a1 having polymerizable unsaturated group and the other compounds through the polymerizable unsaturated groups possessed by each of these compounds.

Other vinylic monomer may be used for resin A besides the previously described monomers and polymers. Specific examples of this other vinylic monomer are given in the following.

Aliphatic vinyl hydrocarbons: alkenes, for example, ethylene, propylene, butene, isobutylene, pentene, heptene, diisobutylene, octene, dodecene, octadecene, and α-olefins other than the preceding; alkadienes, for example, butadiene, isoprene, 1,4-pentadiene, 1,5-hexadiene, and 1,7-octadiene.

Alicyclic vinyl hydrocarbons: mono- and di-cycloalkenes and -alkadienes, for example, cyclohexene, cyclopentadiene, vinylcyclohexene, and ethylidenebicycloheptene; terpenes, for example, pinene, limonene, and indene.

Aromatic vinyl hydrocarbons: styrene and its hydrocarbyl (alkyl, cycloalkyl, aralkyl, and/or alkenyl)-substitution products, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxyl group-containing vinylic monomers and their metal salts: carboxyl group-containing vinylic monomers such as $C_{3-30}$ unsaturated monocarboxylic acids and unsaturated dicarboxylic acids and their anhydrides and monoalkyl ($C_{1-27}$) esters, e.g., acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoether itaconate, citraconic acid, monoalkyl esters of citraconic acid, and cinnamic acid.

Vinyl esters, for example, vinyl acetate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates having a $C_{1-11}$ alkyl group (linear chain or branched) (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate), dialkyl fumarates (the dialkyl esters of fumaric acid) (the two alkyl groups are linear chain, branched chain, or alicyclic groups having at least 2 and not more than 8 carbons), and dialkyl maleates (the dialkyl esters of maleic acid) (the two alkyl groups are linear chain, branched chain, or alicyclic groups having at least 2 and not more than 8 carbons); polyallyloxyalkanes (diallyloxyethane, triallyloxyethane, tetraallyloxyethane, tetrallyloxypropane, tetraallyloxybutane, tetramethallyloxyethane); vinylic monomers that have a polyalkylene glycol chain (polyethylene glycol (molecular weight=300) monoacrylate, polyethylene glycol (molecular weight=300) monomethacrylate, polypropylene glycol (molecular weight=500) monoacrylate, polypropylene glycol (molecular weight=500) monomethacrylate, the acrylate of a methyl alcohol/10 mol ethylene oxide adduct (ethylene oxide is abbreviated as EO below), the methacrylate of a methyl alcohol/10 mol ethylene oxide adduct (ethylene oxide is abbreviated as EO below), the acrylate of a lauryl alcohol/30 mol EO adduct, and the methacrylate of a lauryl alcohol/30 mol EO adduct); and polyacrylates and polymethacrylates (the polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Styrene and methacrylic acid are preferred among the preceding for the other vinylic monomer.

This other vinylic monomer may be contained at least 10.0 mass parts and not more than 50.0 mass parts per 100.0 mass parts of the monomer or polymer that forms the resin A.

There are no particular limitations in the production method of the present invention on the method of producing the resin A-containing resin fine particles. They can be obtained, for example, by a method in which, in the production of the resin A, a composition containing the monomer and/or polymer that will form the resin A is dissolved in an organic solvent, droplets of the resulting solution are dispersed in a dispersion medium, and the polymerizable compounds in the droplets are then polymerized; or by a method in which, e.g., the polymer that will form the resin A is melt kneaded and then cooled and then pulverized.

The particle diameter of the resin fine particle is preferably at least 30 nm and not more than 300 nm as the volume-average particle diameter. At least 50 nm and not more than 250 nm is more preferred.

The droplet stability in step (i) is improved when the particle diameter of the resin fine particle is in the aforementioned range. The particle diameter of the droplets is also readily controlled to a desired size.

The amount of incorporation of the resin fine particle is preferably at least 3.0 mass parts and not more than 15.0 mass parts per 100 mass parts of the amount of solids in the solution in step (i) of the materials that will form the toner (or resin particle), and can be adjusted as appropriate in conformity to the droplet stability and the desired particle diameter.

There are no particular limitations in the production method of the present invention on the resin (also referred to hereafter as resin C) contained in the core, and the resins commonly used in toner particles can be used.

Examples here are polyester resins, vinyl resins, polyurethane resins, and polyurea resins. Polyester resins are preferred among these.

A crystalline resin or an amorphous resin may be used for the resin C.

The crystalline resin here exhibits a clear melting point peak in differential scanning calorimetric measurement using a differential scanning calorimeter (DSC); undergoes almost no softening up to temperatures below the melting point; and, when a temperature higher than the melting point is assumed, undergoes melting and abruptly softens.

When the resin particle is used as a toner particle, the use of a crystalline resin for the resin C makes it possible for the low-temperature fixability and the heat-resistant storability to co-exist in good balance, and as a consequence the resin C preferably contains a crystalline resin and more preferably contains a crystalline polyester resin.

This crystalline polyester resin can be selected from the crystalline polyesters usable for the crystalline polymer D.

The melting point of this crystalline resin is preferably at least 50° C. and not more than 90° C.

A crystalline vinyl resin can also be incorporated as a crystalline resin in the resin C in the present invention. This crystalline vinyl resin can be selected from the crystalline vinyl polymers usable for the crystalline polymer D The content of the crystalline resin, expressed with respect to the total amount of the resin C, is preferably at least 50.0 mass % and not more than 90.0 mass % and is more preferably at least 70.0 mass % and not more than 85.0 mass %.

An amorphous resin may be incorporated in the resin C in the present invention. In the case of use as a toner particle, the incorporation of an amorphous resin facilitates the retention of elasticity by the toner particle in the fixing region after sharp melting has occurred.

The amorphous resin should not exhibit a clear melting point peak in differential scanning calorimetric measurement, but is not otherwise particularly limited, and the same amorphous resins as those that are commonly used as toner particle resins can be used. However, the glass transition temperature (Tg) of the amorphous resin is preferably at least 50° C. and not more than 130° C. and is more preferably at least 70° C. and not more than 130° C.

The amorphous resin can be specifically exemplified by amorphous polyester resins, amorphous polyurethane resins, and amorphous vinyl resins. These resins may also be modified by, for example, urethane, urea, or epoxy. Amorphous polyester resins and amorphous polyurethane resins are favorable examples among the preceding from the standpoint of elasticity retention.

The amorphous polyester resins are described in the following.

The monomers that can be used to produce the amorphous polyester resin can be exemplified by heretofore known dibasic and tribasic and higher basic carboxylic acids and dihydric and trihydric and higher hydric alcohols. Specific examples of these monomers are provided in the following.

The dibasic carboxylic acids can be exemplified by the following compounds: dibasic acids such as succinic acid, adipic acid, sebacic acid, phthalic acid, isophthalic acid, terephthalic acid, malonic acid, and dodecenylsuccinic acid and their anhydrides and lower alkyl esters, and also aliphatic unsaturated dicarboxylic acids such as maleic acid, fumaric acid, itaconic acid, and citraconic acid.

The tribasic and higher basic carboxylic acids can be exemplified by the following compounds: 1,2,4-benzenetricarboxylic acid and 1,2,5-benzenetricarboxylic acid and their anhydrides and lower alkyl esters. A single one of these may be used by itself or two or more may be used in combination.

The dihydric alcohols can be exemplified by the following compounds: alkylene glycols (ethylene glycol, 1,2-propylene glycol, and 1,3-propylene glycol), alkylene ether glycols (polyethylene glycol and polypropylene glycol), alicyclic diols (1,4-cyclohexanedimethanol), bisphenols (bisphenol A), and the alkylene oxide (ethylene oxide and propylene oxide) adducts of alicyclic diols.

The alkyl moiety of the alkylene glycols and alkylene ether glycols may be linear chain or branched. Alkylene glycols having a branched structure are also preferred for use in the present invention.

The trihydric and higher hydric alcohols can be exemplified by the following compounds: glycerol, trimethylolethane, trimethylolpropane, and pentaerythritol. A single one of these may be used by itself or two or more may be used in combination.

As necessary, a monobasic acid such as acetic acid or benzoic acid and/or a monohydric alcohol such as cyclohexanol or benzyl alcohol may also be used for the purpose of adjusting the acid value and/or the hydroxyl value.

There is no particular limitation on the method for synthesizing the amorphous polyester resin, and, for example, a transesterification method or direct polycondensation method can be used by itself or a combination thereof can be used.

The amorphous polyurethane resins are described in the following. Polyurethane resins are the reaction product of a diol and a compound that contains two isocyanate groups. Resins having different functionalities can be obtained by adjusting the diol and the compound that contains two isocyanate groups. This compound that contains two isocyanate groups can be selected from the diisocyanate usable for the the crystalline polyester a1.

A trifunctional or higher functional isocyanate compound can also be used in addition to these diisocyanates. The diols that can be used for the amorphous polyurethane resin are the same as the dihydric alcohols that can be used for the previously described amorphous polyesters.

The amorphous vinyl resins are described in the following. The following compounds are examples of the monomer that can be used to produce an amorphous vinyl resin.

Aliphatic vinyl hydrocarbons: alkenes (ethylene, propylene, butene, isobutylene, pentene, heptene, diisobutylene, octene, dodecene, octadecene, and α-olefins other than the preceding); alkadienes (butadiene, isoprene, 1,4-pentadiene, 1,5-hexadiene, and 1,7-octadiene).

Alicyclic vinyl hydrocarbons: mono- and di-cycloalkenes and -alkadienes (cyclohexene, cyclopentadiene, vinylcyclohexene, and ethylidenebicycloheptene); terpenes (pinene, limonene, and indene).

Aromatic vinyl hydrocarbons: styrene and its hydrocarbyl (alkyl, cycloalkyl, aralkyl, and/or alkenyl)-substitution products (α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene); and vinylnaphthalene.

Carboxyl group-containing vinyl monomers and their metal salts: $C_{3-30}$ unsaturated monocarboxylic acids and unsaturated dicarboxylic acids and their anhydrides and monoalkyl ($C_{1-11}$) esters (carboxyl group-containing vinylic monomers such as maleic acid, maleic anhydride, monoalkyl esters of maleic acid, fumaric acid, monoalkyl esters of fumaric acid, crotonic acid, itaconic acid, monoalkyl esters of itaconic acid, glycol monoether itaconate, citraconic acid, monoalkyl esters of citraconic acid, and cinnamic acid).

Vinyl esters (vinyl acetate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate).

Alkyl acrylates and alkyl methacrylates having a $C_{1-11}$ alkyl group (linear chain or branched) (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate), dialkyl fumarates (the dialkyl esters of fumaric acid) (the two alkyl groups are linear chain, branched chain, or alicyclic groups having at least 2 and not more than 8 carbons), and dialkyl maleates (the dialkyl esters of maleic acid) (the two alkyl groups are linear chain, branched chain, or alicyclic groups having at least 2 and not more than 8 carbons).

Polyallyloxyalkanes (diallyloxyethane, triallyloxyethane, tetraallyloxyethane, tetrallyloxypropane, tetraallyloxybutane, tetramethallyloxyethane); vinylic monomers that have a polyalkylene glycol chain (polyethylene glycol (molecular weight=300) monoacrylate, polyethylene glycol (molecular weight=300) monomethacrylate, polypropylene glycol (molecular weight=500) monoacrylate, polypropylene glycol (molecular weight=500) monomethacrylate, the acrylate of a methyl alcohol/10 mol ethylene oxide adduct (ethylene oxide is abbreviated as EO below), the methacrylate of a methyl alcohol/10 mol ethylene oxide adduct (ethylene oxide is abbreviated as EO below), the acrylate of a lauryl alcohol/30 mol EO adduct, and the methacrylate of a lauryl alcohol/30 mol EO adduct).

Polyacrylates and polymethacrylates (the polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

The content of the amorphous resin, expressed relative to the total amount of the resin C, is preferably at least 10.0 mass % and not more than 50.0 mass % and is more preferably at least 15.0 mass % and not more than 30.0 mass %.

The use as the resin C of a block polymer in which a crystalline resin is chemically bonded to an amorphous resin is preferred in the present invention.

The block polymer can be exemplified by XY diblock polymers, XYX triblock polymers, Y×Y triblock polymers, and XYXY . . . multiblock polymers of a crystalline resin (X) and an amorphous resin (Y), and any mode can be used.

The following methods, for example, can be used to prepare the block polymer in the present invention: a method (two-stage method) in which the crystalline resin and amorphous resin are separately prepared and the two are then bonded; a method (single-stage method) in which the monomer that will form the crystalline resin and the monomer that will form the amorphous resin are charged simultaneously and preparation is carried out all at once. The block polymer can be provided by selecting from the different methods based on a consideration of the reactivities of the respective terminal functional groups.

When the crystalline resin and the amorphous resin are both polyester resins, preparation may be carried out by bonding, as necessary using a linker, after the individual resins have been separately prepared. When, in particular, one of the polyester resins has a high acid value and the other polyester resin has a high hydroxyl value, bonding may be brought about without using a linker. The reaction temperature here is preferably around 200° C.

When a linker is used, this linker can be exemplified by the following: polybasic carboxylic acids, polyhydric alcohols, polyisocyanates, polyfunctional epoxides, and polyfunctional acid anhydrides. Synthesis using these linkers can be carried out by a dehydration reaction or an addition reaction.

When, on the other hand, the crystalline resin is a polyester resin and the amorphous resin is a polyurethane resin, preparation can be carried out by preparing each resin separately and then running a urethanation reaction between terminal alcohol on the polyester resin and terminal isocyanate on the polyurethane resin. Synthesis may also be carried out by mixing a polyester resin having terminal alcohol with the diol and the compound having two isocyanate groups that will form the polyurethane resin and heating.

In the initial phase of the reaction where the diol and the compound having two isocyanate groups are present at high concentrations, the diol and compound having two isocyanate groups will selectively react to provide the polyurethane resin, and, once the molecular weight has reached a certain magnitude, the block polymer can be provided through the occurrence of a urethanation reaction between the terminal isocyanate of the polyurethane resin and the terminal alcohol of the polyester resin.

When the crystalline resin and amorphous resin are both vinyl resins, preparation can be carried out by polymerizing one resin followed by the initiation, from the terminal of this vinyl polymer, of the polymerization of the other resin.

The content of the crystalline resin in this block polymer is preferably at least 50.0 mass % and not more than 90.0 mass % and is more preferably at least 70.0 mass % and not more than 85.0 mass %.

The usual organic solvents capable of dissolving the resin that will be present in the core can be used as the organic solvent in step (i), for example, as follows:

ketone solvents such as acetone, methyl ethyl ketone, methyl isobutyl ketone, and di-n-butyl ketone; ester solvents such as ethyl acetate, butyl acetate, and methoxybutyl acetate; ether solvents such as tetrahydrofuran, diethyl ether, dioxane, ethyl cellosolve, and butyl cellosolve; amide solvents such as dimethylformamide and dimethylacetamide; and aromatic hydrocarbon solvents such as toluene, xylene, and ethylbenzene.

Among the preceding, the ketone solvents, ester solvents, and ether solvents are preferred and the ketone solvents and ether solvents are more preferred.

The amount of addition of the organic solvent, expressed per 100.0 mass parts of the amount of solids originating with the resins that will constitute the toner (or resin particle), is preferably at least 50.0 mass parts and not more than 1000.0 mass parts and is more preferably at least 100.0 mass parts and not more than 800.0 mass parts.

The amount of addition of the dispersion medium, expressed per 100.0 mass parts of the amount of solids originating with the resins that will constitute the toner (or resin particle), is preferably at least 50.0 mass parts and is more preferably at least 100.0 mass parts.

When the resin particle is used as a toner particle, a wax may as necessary be incorporated in the production method of the present invention. In the DSC measurement of the toner (or resin particle), the peak temperature of the maximum endothermic peak of the wax is preferably higher than the peak temperature of the maximum endothermic peak of the resin A.

The wax can be exemplified by the following, but there is no limitation to these:

aliphatic hydrocarbon waxes such as low molecular weight polyethylene, low molecular weight polypropylene, low molecular weight olefin copolymers, microcrystalline waxes, paraffin waxes, and Fischer-Tropsch waxes; the oxides of aliphatic hydrocarbon waxes, such as oxidized polyethylene wax; waxes for which the main component is a fatty acid ester, such as aliphatic hydrocarbon ester waxes; waxes provided by the partial or complete deacidification of fatty acid esters, such as deacidified carnauba wax; partial esters between a fatty acid and a polyhydric alcohol, such as behenyl monoglyceride; and the hydroxyl group-bearing methyl ester compounds obtained by the hydrogenation of vegetable oils.

Considered from the standpoint of the ease of preparation of the wax dispersion and the ease of incorporation in the produced resin particle in the dissolution suspension method, and, in the case of utilization as a toner particle, also considered from the standpoint of the releasability and bleed-out behavior from the toner particle during fixing, aliphatic hydrocarbon waxes and ester waxes are waxes particularly preferred for use in the present invention.

As long as at least one ester bond is present in each molecule, a natural ester wax or a synthetic ester wax may be used as the ester wax here.

The synthetic ester waxes can be exemplified by monoester waxes synthesized from a long-chain linear saturated fatty acid and a long-chain linear saturated aliphatic alcohol.

A long-chain linear saturated fatty acid with the general formula $C_nH_{2n+1}COOH$ where n is at least 5 and not more than 28 is preferably used as the long-chain linear saturated fatty acid. A long-chain linear saturated aliphatic alcohol with the general formula $C_nH_{2n+1}OH$ where n is at least 5 and not more than 28 is preferably used as the long-chain linear saturated aliphatic alcohol.

The natural ester waxes can be exemplified by candelilla wax, carnauba wax, rice wax, and their derivatives.

Among the preceding, natural ester waxes and synthetic ester waxes from a long-chain linear saturated fatty acid and a long-chain linear saturated aliphatic alcohol are preferred. In addition to the linear chain structure, esters that are monoesters are more preferred in the present invention. The use of a hydrocarbon wax is also a preferred embodiment in the present invention.

The content of the wax in the toner (or resin particle) in the production method of the present invention, expressed per 100 mass parts of the resin component in the toner (or resin particle), is preferably at least 1.0 mass parts and not more than 20.0 mass parts and is more preferably at least 2.0 mass parts and not more than 15.0 mass parts.

When the resin particle is used as a toner particle, the adjustment of the wax content into the indicated range makes it possible to bring about additional improvements in the releasability of the toner particle, and wrap around by the transfer paper can then be suppressed even when the fixing member is brought to low temperatures. Moreover, exposure of the wax at the toner particle surface can be brought into a favorable state and due to this additional improvements in the heat-resistant storability can be brought about.

The wax preferably has a peak temperature for the maximum endothermic peak in differential scanning calorimetric measurement (DSC) of at least 60° C. and not more than 120° C. in the present invention. At least 60° C. and not more than 90° C. is more preferred. When the resin particle is used as a toner particle, the adjustment of the peak temperature of the maximum endothermic peak into the indicated range can bring the exposure of the wax at the toner particle surface to a favorable state and as a consequence can bring about additional improvements in the heat-resistant storability. On the other hand, an appropriate melting by the wax during fixing is facilitated and as a result additional improvements in the low-temperature fixability and offset resistance can be brought about.

When the resin particle is used as a toner particle, a colorant may be incorporated in the production method of the present invention in order to impart tinting strength. Colorants that are preferred for use can be exemplified by organic pigments, organic dyes, inorganic pigments, carbon black and magnetic powders functioning as a black colorant, and the colorants heretofore used in toner particles can be used.

Yellow colorants can be exemplified by the following: condensed azo compounds, isoindolinone compounds, anthraquinone compounds, azo metal complexes, methine compounds, and allylamide compounds. Specifically, C. I. Pigment Yellow 12, 13, 14, 15, 17, 62, 74, 83, 93, 94, 95, 109, 110, 111, 128, 129, 147, 155, 168, and 180 are advantageously used.

Magenta colorants can be exemplified by the following: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specifically, C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 are advantageously used.

The cyan colorants can be exemplified by the following: copper phthalocyanine compounds and their derivatives, anthraquinone compounds, and basic dye lake compounds. Specifically, C. I. Pigment Blue 1, 7, 15, 15:1, 15:2, 15:3, 15:4, 60, 62, and 66 are advantageously used.

A single one of these colorants may be used by itself or a mixture of these colorants may be used, and they may be used in the form of a solid solution. The colorant used is selected considering the hue angle, chroma, lightness, lightfastness, OHP transparency, and dispersibility in the toner particle composition.

The colorant content is preferably at least 1.0 mass parts and not more than 20.0 mass parts per 100.0 mass parts of the resin component in the toner (or resin particle). When carbon black is used in the role of a black colorant, the colorant content is likewise preferably at least 1.0 mass parts and not more than 20.0 mass parts per 100.0 mass parts of the resin component in the toner (or resin particle).

When the resin particle is used as a toner particle, the resin particle may as necessary contain a charge control agent in the present invention. External addition to the resin particle may also be carried out.

When the resin particle is used as a toner particle, the incorporation of a charge control agent makes it possible to stabilize the charging characteristics and to optimally control the amount of triboelectric charging in accordance with the developing system. A known charge control agent can be used as the charge control agent, and a charge control agent that supports a rapid charging speed and that can stably maintain a constant amount of charge is preferred in particular.

Organometal compounds and chelate compounds are effective as charge control agents that control the resin to a negative chargeability and can be exemplified by monoazo metal compounds, acetylacetone-metal compounds, and metal compounds of aromatic oxycarboxylic acids, aromatic dicarboxylic acids, oxycarboxylic acids, and dicarboxylic acids. Charge control agents that control the toner particle to a positive chargeability can be exemplified by nigrosine, quaternary ammonium salts, metal salts of higher fatty acids, diorganotin borates, guanidine compounds, and imidazole compounds.

The content of the charge control agent, expressed per 100.0 mass parts of the resin component in the toner (or resin particle), is preferably at least 0.01 mass parts and not more than 20.0 mass parts and is more preferably at least 0.5 mass parts and not more than 10.0 mass parts.

When the resin particle is used as a toner particle, it may also be used after the external addition of inorganic fine particles to the resin particle in the production method of the present invention. When the resin particle is used as a toner particle, these inorganic fine particles function to improve the flowability of the toner particle and function to make the charge on the toner particle uniform. These inorganic fine particles can be exemplified by fine particles such as silica fine particles, titanium oxide fine particles, alumina fine particles, and their complex oxide fine particles. Among these inorganic fine particles, silica fine particles and titanium oxide fine particles are preferred.

The silica fine particles can be exemplified by a fumed silica or dry silica produced by the vapor-phase oxidation of a silicon halide, and by a wet silica produced from water glass. Dry silica, which has little silanol group at the surface or within the silica fine particle and which has little $Na_2O$ and $SO_3^{2-}$, is preferred as the inorganic fine particle. Moreover, the dry silica may also be a composite fine particle of silica and another metal oxide as produced by the use in the production process of a metal halide compound, for example, aluminum chloride or titanium chloride, along with the silicon halide compound.

In addition, the inorganic fine particle is more preferably a hydrophobically treated inorganic fine particle because an improved regulation of the amount of charge on the toner particle, an improved environmental stability, and improvements in the properties in high-humidity environments can be achieved by subjecting the inorganic fine particle itself to a hydrophobic treatment. When moisture is absorbed by an inorganic fine particle that has been externally added to a toner particle, the amount of charge on the toner particle declines and a trend is set up in which the occurrence of reductions in the developing performance and/or transferability is facilitated.

The treatment agent used for the hydrophobic treatment of the inorganic fine particles can be exemplified by unmodified silicone varnishes, variously modified silicone varnishes, unmodified silicone oils, variously modified silicone oils, silane compounds, silane coupling agents, organosilicon compounds other than the preceding, and organotitanium compounds. A single one of these treatment agents may be used or combinations may be used.

Among the preceding, inorganic fine particles that have been treated with a silicone oil are preferred. Silicone oil-treated hydrophobic-treated inorganic fine particles provided by treating inorganic fine particles with a silicone oil either at the same time as or after their hydrophobic treatment with a silane coupling agent, are more preferred from the standpoint of maintaining a high amount of charge on the toner particle and reducing selective development even in a high-humidity environment.

The amount of addition of the inorganic fine particles, expressed per 100.0 mass parts of the toner particle, is preferably at least 0.1 mass parts and not more than 4.0 mass parts and is more preferably at least 0.2 mass parts and not more than 3.5 mass parts.

The production method of the present invention is described in greater detail in the following.

The step (i) in the production method of the present invention may be either of the following (1) and (2).

(1) A step in which the resin C, the resin fine particles, and the organic solvent are mixed to prepare a resin solution containing the resin C and the resin fine particles; the dispersion medium and this resin solution containing the resin C and the resin fine particles are introduced into a container; and the interior of the container is stirred to prepare a dispersion in which resin solution droplets, the surfaces of which are coated with the resin fine particles, are dispersed in the dispersion medium.

(2) A step in which the resin C and the organic solvent are mixed to prepare a resin solution containing the resin C; the dispersion medium, the resin fine particles, and this resin solution containing the resin C are introduced into a container; and the interior of the container is stirred to prepare a dispersion in which resin solution droplets, the surfaces of which are coated with the resin fine particles, are dispersed in the dispersion medium.

The mixing of the resin C, resin fine particles, and the organic solvent, or the mixing of the resin C and the organic solvent, should be a mixing to uniformity using an ordinary mixing apparatus, but is not otherwise particularly limited. The ordinary mixing apparatus can be exemplified by dispersing devices such as homogenizers, ball mills, colloid mills, and ultrasonic dispersers. In addition, the order of mixing is also not particularly limited.

As necessary, wax, colorant, and charge control agent may also be admixed in this step.

Production in the production method of the present invention can be carried out as follows in those instances in which production is carried out using a carbon dioxide-containing dispersion medium as the dispersion medium.

Any method may be used for the method of dispersing the resin solution in the dispersion medium in step (1) or (2) when a carbon dioxide-containing dispersion medium is used as the dispersion medium. A specific example is a method in which, as shown in FIG. 1, the resin solution is introduced using a high-pressure pump into a container containing a carbon dioxide-containing dispersion medium residing in a high-pressure state and in a state in which the dispersant is dispersed. In addition, the carbon dioxide-containing dispersion medium residing in a high-pressure state and in a state in which the dispersant is dispersed, may be introduced into a container that has already been charged with the resin solution.

Any method may be used as the method for stirring the dispersion in steps (ii) and (iii), and the method of stirring within the granulation tank t1 shown in FIG. 1 is a specific example.

When, in the production method of the present invention, the droplets are formed by dispersing the resin solution in a carbon dioxide-containing dispersion medium, a portion of the organic solvent in the droplets transfers into the dispersion medium. At this time, a trend of a declining droplet stability is assumed when the carbon dioxide phase and organic solvent phase are present in a separated state. Accordingly, the temperature and pressure of the dispersion medium and the amount of the resin solution relative to the carbon dioxide are preferably adjusted to within ranges in which the carbon dioxide and organic solvent can form a homogeneous phase.

The solubility in the dispersion medium of the constituent components in the resin solution and the granulating properties (ease of droplet formation) are also preferably taken into account with regard to the temperature and pressure of the dispersion medium. For example, the resin C and wax in the resin solution can dissolve in the dispersion medium depending on the temperature conditions and pressure conditions. Generally, at lower temperatures and lower pressures, the solubility of these components in the dispersion medium is more restrained, but the occurrence of aggregation and coalescence of the formed droplets is facilitated and the granulating properties are reduced. On the other hand, at higher temperatures and higher pressures, the granulating properties are improved, but a trend is exhibited whereby dissolution of these components in the dispersion medium is facilitated. Accordingly, the temperature of the dispersion medium in resin particle production is preferably in the temperature range from at least 10° C. to not more than 40° C.

In addition, the pressure (gauge pressure) within the container where the dispersion medium is formed is preferably at least 1.0 MPa and not more than 8.0 MPa and is more preferably at least 1.0 MPa and not more than 5.0 MPa. The pressure in the production method of the present invention refers to the total pressure in those instances in which a component besides carbon dioxide is present in the dispersion medium.

A step (iii) of cooling the dispersion to a temperature lower than the temperature Ta (° C.) is additionally present in the production method of the present invention between the step (i) and the step (ii).

The production method of the present invention also has a step (ii) of extracting into the dispersion medium the organic solvent contained in the droplets and of also removing this organic solvent from the dispersion medium.

When a carbon dioxide-containing dispersion medium is used as the dispersion medium, after the droplets have been formed, the organic solvent remaining in the droplets may be removed in step (ii) via the carbon dioxide-containing dispersion medium.

Specifically, this is carried out by mixing additional carbon dioxide-containing dispersion medium into the carbon dioxide-containing dispersion medium in which the droplets are dispersed and extracting the residual organic solvent into the dispersion medium phase, and by replacing this organic solvent-containing dispersion medium with additional carbon dioxide-containing dispersion medium.

The method of flowing carbon dioxide through while maintaining a constant pressure within the container is an example of a method for replacing the carbon dioxide-containing dispersion medium that contains organic solvent with carbon dioxide-containing dispersion medium. This is carried out while using a filter to capture the resin particles that have been formed.

When replacement by carbon dioxide is not adequate and a state is assumed in which organic solvent remains in the dispersion medium, and when the container is then depressurized in order to recover the toner particle (or resin particle) that has been obtained, the organic solvent dissolved in the dispersion medium may condense and the toner particle (or resin particle) may then redissolve, and/or toner particles (or resin particles) may coalesce with each other. Accordingly, replacement with carbon dioxide is preferably carried out until the organic solvent has been completely removed. The amount of throughflowed carbon dioxide is preferably at least 1-time and not more than 100-times the volume of the dispersion medium and is more preferably at least 1-time and not more than 50-times and is even more preferably at least 1-time and not more than 30-times.

Steps (i) to (iii) can be carried out proceeding as follows when production according to the production method of the present invention is carried out at atmospheric pressure using a liquid-state dispersion medium as the dispersion medium.

There are no particular limitations on the method of dispersing the resin solution in step (i) or on the method of stirring the dispersion in steps (ii) and (iii), and these may be carried out using a general-purpose dispersing apparatus or stirring apparatus based on low-speed shear, high-speed shear, friction, a high-pressure jet, or ultrasound. A high-speed shear type is preferred in step (i) in order to bring the dispersed particle diameter to at least 2 μm and not more than 20 μm.

General-purpose emulsifying devices, dispersing devices, and stirring devices can be used as the dispersing apparatus here without particular limitation.

Examples here are continuous emulsifying devices such as the Ultra-Turrax (IKA), Polytron (Kinematica AG), TK Homodisper (Tokushu Kika Kogyo Co., Ltd.), Ebara Milder (Ebara Corporation), TK Homomic Line Flow (Tokushu Kika Kogyo Co., Ltd.), Colloid Mill (Shinko Pantec Co., Ltd.), Slasher and Trigonal Wet Pulverizer (Mitsui Miike Chemical Engineering Machinery Co., Ltd.), Cavitron (Eurotec Co., Ltd.), and Fine Flow Mill (Pacific Machinery & Engineering Co., Ltd.), and batch or continuous dual-use emulsifying devices such as the Clearmix (M Technique Co., Ltd.) and FILMICS (Tokushu Kika Kogyo Co., Ltd.).

A toner particle (or resin particle) is obtained in step (ii) by removing the organic solvent from the droplets in the dispersion and thereby bringing about solidification of the resin component. A method of removal via the dispersion medium through heating or depressurization can be used as the method of removing the organic solvent from the droplets. This is carried out while using a filter to capture the resin particles that have been formed. The resin particles are then obtained by proceeding through filtration, washing, and drying steps.

The weight-average particle diameter (D4) of the resin particle according to the present invention is preferably at least 3.0 μm and not more than 8.0 μm and is more preferably at least 5.0 μm and not more than 7.0 μm.

Having the weight-average particle diameter (D4) of the resin particle be in the indicated range makes it possible, in the case of use as a toner particle, to provide a fully satisfactory dot reproducibility while providing excellent handling characteristics. In addition, for the case of use as a toner particle, the ratio (D4/D1) for the toner particle between the weight-average particle diameter (D4) and the number-average particle diameter (D1) is preferably less than 1.25.

The methods for measuring each of the property values pertinent to the present invention are described in the following.

<Method for Measuring the Weight-Average Particle Diameter (D4), the Number-Average Particle Diameter (D1), and the Coarse Powder Percentage of, e.g., the Resin Particle>

The weight-average particle diameter (D4), the number-average particle diameter (D1), and the coarse powder percentage of, e.g., the resin particle, are determined as follows in the present invention.

The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 for the number of effective measurement channels.

The aqueous electrolyte solution used for the measurements is prepared by dissolving special-grade sodium chloride in deionized water to provide a concentration of approximately 1 mass %, and, for example, "ISOTON II" (from Beckman Coulter, Inc.) can be used.

The dedicated software is configured as follows prior to carrying out measurement and analysis.

In the "modify the standard operating method (SOM)" screen of the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the aqueous electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersant approximately 0.3 mL of a dilution prepared by the approximately threefold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the resin particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed resin particle-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4), the number-average particle diameter (D1), and the coarse powder percentage are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1). The coarse powder percentage is the sum of the volume % of the particles equal to or greater than 10.1 μm on the "analysis/volumetric statistical value (arithmetic average)" screen.

<Method for Measuring the Melting Point>

The melting point of the crystalline polymer, the crystalline resin, and the wax is measured under the following conditions using a Q2000 (TA Instruments) differential scanning calorimeter (DSC).

ramp rate: 10° C./min measurement start temperature: 20° C.

measurement stop temperature: 180° C.

Temperature correction in the instrument detection section is performed using the melting points of indium and zinc, and the amount of heat is corrected using the heat of fusion of indium.

Specifically, approximately 5 mg of the sample is precisely weighed out and this is introduced into an aluminum pan and the measurement is carried out a single time. An empty aluminum pan is used as the reference. In this case, the peak temperature of the maximum endothermic peak is taken to be the melting point.

<Measurement of the Glass Transition Temperature (Tg)>

Using the reversing heat flow curve during ramp up that is obtained in the differential scanning calorimetric measurement of the melting point, the glass transition temperature of the amorphous resin is the temperature (° C.) at the intersection between the curve segment for the stepwise change at the glass transition in the reversing heat flow curve and the straight line that is equidistant, in the direction of the vertical axis, from the straight lines formed by extending the baselines for prior to and subsequent to the appearance of the change in the specific heat.

<Method for Measuring the Number-Average Molecular Weight (Mn) and the Weight-Average Molecular Weight (Mw)>

The number-average molecular weight (Mn) and the weight-average molecular weight (Mw) of the resins and their materials are measured using gel permeation chromatography (GPC) as described below.

(1) Preparation of the Measurement Sample

The sample and tetrahydrofuran (THF) are mixed at a concentration of 5.0 mg/mL; standing is carried out for 5 to 6 hours at room temperature; and then thorough shaking is performed to thoroughly mix the THF and sample until agglomerates of the sample are not present. This is followed by additional standing at quiescence at room temperature for at least 12 hours. The tetrahydrofuran (THF)-soluble matter of the sample is obtained by having the time from the start of the mixing of the sample and THF to the completion of standing at quiescence be at least 72 hours. The sample solution is then obtained by filtration with a solvent-resistant membrane filter (pore size=0.45 to 0.50 μm, Sample Pretreatment Cartridge H-25-2 (from the Tosoh Corporation)).

(2) Measurement of the Sample

Measurement was carried out under the following conditions using the obtained sample solution.

instrument: LC-GPC 150C high-performance GPC instrument (Waters)

columns: 7-column train of Shodex GPC KF-801, 802, 803, 804, 805, 806, and 807 (from Showa Denko Kabushiki Kaisha)

mobile phase: THF flow rate: 1.0 mL/minute column temperature: 40° C.

sample injection amount: 100 μL detector: RI (refractive index) detector

With regard to measurement of the molecular weight of the sample, the molecular weight distribution exhibited by the sample is calculated from the relationship between the count number and logarithmic value of a calibration curve constructed using a plurality of monodisperse standard polystyrene samples.

Standard polystyrene samples having molecular weights of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$, from Pressure Chemical Co. or Tosoh Corporation, are used as the standard polystyrene samples for construction of the calibration curve.

<Calculation of the Crystalline Resin Content (Mass %) and the Average Number of Polymerizable Unsaturated Groups Per Molecule of the Crystalline Polyester Having Polymerizable Unsaturated Group>

The content (mass %) of the crystalline resin in the resin and the average number of polymerizable unsaturated groups per molecule of the crystalline polyester having polymerizable unsaturated group are measured by $^1$H-NMR using the following conditions.

measurement instrument: JNM-EX400 FT-NMR instrument (JEOL Ltd.)

measurement frequency: 400 MHz pulse condition: 5.0 μs frequency range: 10500 Hz number of integrations: 64 measurement temperature: 30° C.

sample: This is prepared by introducing 50 mg of the sample into a sample tube having an inside diameter of mm; adding deuterochloroform ($CDCl_3$) as organic solvent; and carrying out dissolution in a 40° C. thermostat.

<Crystalline Resin Content (Mass %)>

Using the $^1$H-NMR chart measured under the measurement conditions indicated above, from among the peaks assigned to the structural components of the crystalline resin, a peak is selected that is independent from the peaks assigned to the other structural components, and the integration value $S_1$ for this peak is calculated. Similarly, from among the peaks assigned to the structural components of the amorphous resin, a peak is selected that is independent from the peaks assigned to the other structural components, and the integration value $S_2$ for this peak is calculated. The content of the crystalline resin is determined proceeding as follows using this integration value $S_1$ and integration value $S_2$. Here, $n_1$ and $n_2$ are the number of hydrogens in the structural component to which the selected peak is assigned.

$$\text{content (mol \%) of the crystalline resin}=\{(S_1/n_1)/((S_1/n_1)+(S_2/n_2))\}\times100$$

The thereby obtained crystalline resin content (mol %) is converted to mass % using the molecular weights of the individual components.

<Average Number of Polymerizable Unsaturated Groups Per Molecule of the Crystalline Polyester Having Polymerizable Unsaturated Group>

The $^1$H-NMR of the sample is measured and data on the peaks assigned to the following units is obtained.

(1) Y1=unit derived from the polymerizable unsaturated group-containing compound (2) Y2=unit derived from diol free of a polymerizable unsaturated group (3) Y3=unit derived from dicarboxylic acid free of a polymerizable unsaturated group The polymerizable unsaturated group-containing compound here includes the previously described polymerizable unsaturated group-bearing diols and polymerizable unsaturated group-bearing dicarboxylic acids, hydroxyl group-bearing vinylic compounds, and isocyanate group-bearing vinylic compounds.

A characteristic peak P1 that does not coincide with the other units is selected from the peaks assigned to the Y1 unit, and the integration value S1 of the selected peak P1 is calculated.

A characteristic peak P2 that does not coincide with the other units is selected from the peaks assigned to the Y2 unit, and the integration value S2 of the selected peak P2 is calculated.

A characteristic peak P3 that does not coincide with the other units is selected from the peaks assigned to the Y3 unit, and the integration value S3 of the selected peak P3 is calculated.

The average number of polymerizable unsaturated groups per molecule of the crystalline polyester having polymerizable unsaturated group is determined proceeding as follows using this integration value S1, integration value S2, and integration value S3.

$$\text{average number of polymerizable unsaturated groups per molecule of the polymerizable unsaturated group-bearing crystalline polyester}=\{Mp\times(S1/n1)\}/\{M1\times(S1/n1)+M2\times(S2/n2)+M3\times(S3/n3)\}$$

Here, n1, n2, and n3 are the number of hydrogens in unit Y1, unit Y2, and unit Y3, respectively, and M1, M2, and M3 are the molecular weight of the unit Y1, unit Y2, and unit Y3, respectively. Mp is the molecular weight of the polymerizable unsaturated group-bearing crystalline polyester.

<Method of Measuring the Particle Diameter of the Resin Fine Particles, the Wax Fine Particles, and the Colorant Fine Particles>

The particle diameter of the various fine particles is measured in the present invention as the volume-average particle diameter (μm or nm) using a Microtrac HRA (X-100) particle size distribution analyzer (Nikkiso Co., Ltd) and carrying out the measurement at a range setting of 0.001 μm to 10 μm. Water is selected as the dilute solvent.

<Method of Measuring the Amount of Matter Soluble in Organic Solvent, for the Resins and Polymers>

2.0 g of the sample is introduced into a 50.0 mL glass centrifugal separation vial.

To this is added 18.0 g of the organic solvent; dispersion is performed for 10 minutes at 40° C. using a "Tetora 150" ultrasound disperser (Nikkaki Bios Co., Ltd.); the insolubles are sedimented using an "H-103N" centrifugal separator (Kokusan Co., Ltd.) at 5,000 rpm for 5 minutes; and the supernatant is removed.

This process of organic solvent addition, ultrasound dispersion, and centrifugal separation is repeated an additional 4 times to obtain, respectively, a supernatant from the five times and a sediment. Using a beaker, the organic solvent is evaporated in a draft at normal temperature and normal pressure, and, after the deposition of the solids in the sediment and in the supernatant, drying is carried out for an additional 24 hours in a vacuum drier to evaporate the organic solvent. The dry product from the sediment is taken to be the matter insoluble in the organic solvent, and the dry product from the supernatant is taken to be the matter soluble in the organic solvent.

The mass of the matter soluble in the organic solvent is measured and the mass % with respect to the mass of the sample is determined and this is taken to be the percentage for the matter soluble in the organic solvent.

EXAMPLES

The present invention is described in additional detail below using examples, but the present invention is in no way limited thereto. Unless specifically indicated otherwise, the number of parts and % in the examples and comparative examples are on a mass basis in all cases.

<Synthesis of Crystalline Polyester 1>

While introducing nitrogen, the following starting materials were charged to a two-neck flask that had been dried by heating.

| | |
|---|---|
| sebacic acid | 123.9 mass parts |
| 1,6-hexanediol | 76.1 mass parts |
| dibutyltin oxide | 0.1 mass parts |

After nitrogen substitution of the system interior by a pressure reduction process, stirring was carried out for 6 hours at 180° C. Then, while continuing to stir, the temperature was gradually raised to 230° C. under reduced pressure followed by holding for an additional 2 hours. Crystalline polyester 1 was synthesized by air cooling, once a viscous state had been assumed, to stop the reaction. Crystalline polyester 1 had a number-average molecular weight (Mn) of 5,500, a weight-average molecular weight (Mw) of 12,300, and a melting point of 67.0° C.

<Synthesis of Resin C1>

While introducing nitrogen, the following starting materials were charged to a two-neck flask that had been dried by heating.

| | |
|---|---|
| xylylene diisocyanate (XDI) | 56.0 mass parts |
| cyclohexanedimethanol (CHDM) | 34.0 mass parts |
| tetrahydrofuran (THF) | 100.0 mass parts |

Heating to 50.0° C. was carried out and a urethanation reaction was performed for 10 hours. After this, a solution of 210.0 mass parts of crystalline polyester 1 dissolved in 220.0 mass parts of THF was gradually added and stirring was carried out for an additional 5 hours at 50.0° C. Resin C1 was then synthesized by cooling to room temperature and distilling off the THF organic solvent. Resin C1 had a number-average molecular weight (Mn) of 16,800, a weight-average molecular weight (Mw) of 35,500, and a melting point of 59.0° C. The content of the crystalline resin in resin C1 was 70.0 mass %.

<Preparation of Resin C1 Solution>

50.0 mass parts of acetone and 50.0 mass parts of resin C1 were introduced into a stirring apparatus-equipped beaker; heating to a temperature of 50.0° C. was carried out; and stirring was continued until complete dissolution had occurred to prepare a resin solution 1. The obtained resin C1 solution was stored in a storage cabinet having an interior temperature of 40.0° C.

<Synthesis of Polymerizable Unsaturated Group-Bearing Crystalline Polyester 1>

While introducing nitrogen, the following starting materials were charged to a two-neck flask that had been dried by heating.

| | |
|---|---|
| sebacic acid | 93.0 mass parts |
| fumaric acid | 3.9 mass parts |
| 1,12-dodecanediol | 103.1 mass parts |
| dibutyltin oxide | 0.1 mass parts |

After nitrogen substitution of the system interior by a pressure reduction process, stirring was carried out for 6 hours at 180° C. Then, while continuing to stir, the temperature was gradually raised to 230° C. under reduced pressure followed by holding for an additional 2 hours. Polymerizable unsaturated group-bearing crystalline polyester 1 was synthesized by air cooling, once a viscous state had been assumed, to stop the reaction. Polymerizable unsaturated group-bearing crystalline polyester 1 had a number-average molecular weight (Mn) of 12,200, a weight-average molecular weight (Mw) of 24,600, and a melting point of 83.0° C.

<Synthesis of Polymerizable Unsaturated Group-Bearing Crystalline Polyesters 2 to 6>

Polymerizable unsaturated group-bearing crystalline polyesters 2 to 6 were synthesized proceeding as in Synthesis of Polymerizable Unsaturated Group-Bearing Crystalline Polyester 1, but changing the dicarboxylic acid component and diol component as shown in Table 1. The properties of the obtained polymerizable unsaturated group-bearing crystalline polyesters 2 to 6 are given in Table 2. In Table 2, A* shows the average number of polymerizable unsaturated groups present per molecule and B* shows the amount (mass %) of matter soluble in acetone at a temperature of 35° C.

TABLE 1

| polymerizable unsaturated group-bearing crystalline polyester No. | dicarboxylic acid component (mass parts) | | | diol component (mass parts) | |
|---|---|---|---|---|---|
| | sebacic acid | dodecane dioic acid | fumaric acid | 1,6-hexane diol | 1,12-dodecane diol |
| 1 | 93.0 | — | 3.9 | | 103.1 |
| 2 | 108.8 | — | 3.2 | 41.0 | 47.0 |
| 3 | 99.0 | — | 6.0 | 25.0 | 70.0 |
| 4 | 94.0 | — | 3.0 | — | 103.0 |
| 5 | 90.5 | — | 5.8 | — | 103.7 |
| 6 | — | 99.0 | 4.0 | — | 97.0 |

TABLE 2

| polymerizable unsaturated group-bearing crystalline polyester No. | molecular weight Mn | Mw | Mw/Mn | A * | B * | melting point (° C.) |
|---|---|---|---|---|---|---|
| 1 | 12200 | 24600 | 2.0 | 2.1 | 98.2 | 83.0 |
| 2 | 14900 | 26700 | 1.8 | 2.0 | 98.7 | 74.0 |
| 3 | 10300 | 24300 | 2.4 | 3.6 | 96.8 | 76.0 |
| 4 | 9800 | 21400 | 2.2 | 1.5 | 96.5 | 83.0 |
| 5 | 12500 | 21400 | 1.7 | 3.6 | 97.2 | 82.0 |
| 6 | 12700 | 30000 | 2.4 | 2.0 | 80.0 | 88.0 |

<Preparation of Polymerizable Unsaturated Group-Bearing Crystalline Polyester Solution 1>

| | |
|---|---|
| polymerizable unsaturated group-bearing crystalline polyester 1 | 2.5 mass parts |
| acetone | 195.9 mass parts |

were introduced into a stirring apparatus-equipped beaker and, after the temperature had been adjusted to 40.0° C., were stirred for 1 minute at 3,000 rpm using a TK Homodisper (Tokushu Kika Kogyo Co., Ltd.) to obtain a polymerizable unsaturated group-bearing crystalline polyester solution 1.

<Measurement at 2.0 MPa of the Temperature at which the Heat Generation Accompanying Crystal Precipitation is First Observed, for Polymerizable Unsaturated Group-Bearing Crystalline Polyester 1>

The following was used for the granulation tank t1 in the apparatus shown in the FIGURE: a pressure-resistant tank fitted in its interior with a stirring apparatus and a thermocouple and fitted on its sides with a jacket for adjusting the temperature.

198.4 mass parts of the polymerizable unsaturated group-bearing crystalline polyester solution 1 was charged to the granulation tank t1 after its interior temperature had been preliminarily adjusted to 40.0° C.; the valve V1 and the pressure-regulating valve V2 were closed; and the polymerizable unsaturated group-bearing crystalline polyester solution 1 was adjusted to a temperature of 40.0° C. while stirring the interior of the granulation tank t1 at a rotation rate of 300 rpm.

The valve V1 was then opened; carbon dioxide (purity=99.99%) was introduced from the compressed gas cylinder B1 into the granulation tank t1; and the valve V1 was closed once the internal pressure reached a gauge pressure of 2.0 MPa. The mass of the introduced carbon dioxide was 220.0 mass parts when measured using a mass flow meter.

Then, while cooling the 40.0° C. polymerizable unsaturated group-bearing crystalline polyester solution 1 at a ramp down rate of 0.5/min and at a gauge pressure of 2.0 MPa, the temperature change of the polymerizable unsaturated group-bearing crystalline polyester solution 1 was measured using the thermocouple. As a result, when the temperature of the polymerizable unsaturated group-bearing crystalline polyester solution 1 had dropped to 27.0° C., the appearance of a deviation from the temperature reduction rate of the jacket was observed. This temperature was taken to be the temperature at 2.0 MPa at which the heat generation accompanying crystal precipitation is first observed (also referred to herebelow simply as the crystal precipitation onset temperature) for polymerizable unsaturated group-bearing crystalline polyester 1.

<Preparation of Polymerizable Unsaturated Group-Bearing Crystalline Polyester Solutions 2 to 7>

Polymerizable unsaturated group-bearing crystalline polyester solutions 2 to 7 were prepared proceeding as in Preparation of Polymerizable Unsaturated Group-Bearing Crystalline Polyester Solution 1, but using the changes shown in Table 3.

<Measurement of the Crystal Precipitation Onset Temperature at 1.5 MPa, 5.0 MPa, and 10.0 MPa, for Polymerizable Unsaturated Group-Bearing Crystalline Polyester 1>

The crystal precipitation onset temperature was measured for polymerizable unsaturated group-bearing crystalline polyester 1 proceeding as in the measurement of the crystal precipitation onset temperature at 2.0 MPa for polymerizable unsaturated group-bearing crystalline polyester 1, but changing the measurement pressure (gauge pressure) to 1.5 MPa, 5.0 MPa, and 10.0 MPa. The results of the measurements are given in Table 3.

<Measurement of the Crystal Precipitation Onset Temperature for Polymerizable Unsaturated Group-Bearing Crystalline Polyesters 2 to 6>

The crystal precipitation onset temperature was measured for polymerizable unsaturated group-bearing crystalline polyesters 2 to 6 proceeding as in the measurement of the crystal precipitation onset temperature for polymerizable unsaturated group-bearing crystalline polyester 1, but changing the type of the polymerizable unsaturated group-bearing crystalline polyester and the measurement pressure (gauge pressure) as shown in Table 3. The results of the measurements are given in Table 3.

TABLE 3

| polymerizable unsaturated group-bearing crystalline polyester solution No. | polymerizable unsaturated group-bearing crystalline polyester No. | mass ratio of the crystalline polyester with respect to the organic solvent (%) | crystal precipitation onset temperature (° C.) 1.5 MPa | 2.0 MPa | 5.0 MPa | 10 MPa |
|---|---|---|---|---|---|---|
| 1 | 1 | 1.3 | 28.1 | 27.0 | 32.4 | 36.3 |
| 2 | 1 | 1.7 | — | 27.0 | — | — |
| 3 | 2 | 0.4 | 21.0 | 18.8 | 23.7 | 30.4 |
| 4 | 3 | 0.4 | — | 23.1 | — | — |
| 5 | 4 | 1.3 | — | 26.5 | — | — |
| 6 | 5 | 1.3 | — | 34.1 | — | — |
| 7 | 6 | 1.3 | — | 34.1 | — | — |

<Preparation of Organopolysiloxane Compounds 1 and 2>

Commercially available organopolysiloxanes modified by vinyl at one terminal, as shown in Table 4, were prepared and were used as organopolysiloxane compounds 1 and 2 in the present invention. The structure of organopolysiloxane compounds 1 and 2 is given by the following formula (E), while the definitions of $R^2$ to $R^5$ and the values of the degree of polymerization n are given in Table 4.

formula (E)

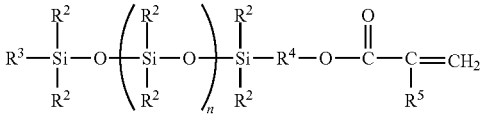

TABLE 4

| | product name | manufacturer | molecular weight | $R^2$ | $R^3$ | $R^4$ | $R^5$ | degree of polymerization n |
|---|---|---|---|---|---|---|---|---|
| organo polysiloxane compound 1 | X-22-2475 | Shin-Etsu Chemical Co., Ltd. | 420 | methyl group | methyl group | propylene group | methyl group | 3 |
| organo polysiloxane compound 2 | X-22-174BX | Shin-Etsu Chemical Co., Ltd. | 2300 | methyl group | methyl group | propylene group | methyl group | 29 |

<Preparation of Polyfunctional Monomer 1>

A commercially available polyfunctional monomer (APG-400, Shin-Nakamura Chemical Co., Ltd.) was prepared and used as polyfunctional monomer 1 in the present invention. The structure of polyfunctional monomer 1 is given by the following formula (F), and the total of the degrees of polymerization m and n is 7 and the molecular weight is 536.

formula (F)

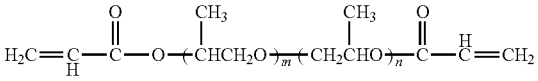

<Preparation of Resin Fine Particle Dispersion 1>

2.0 mass parts of sodium dodecyl sulfate and 1600.0 mass parts of deionized water were introduced into a stirring apparatus-equipped beaker and stirring was continued at 25.0° C. until complete dissolution had been achieved to prepare aqueous medium 1. Then, the following starting materials and 160.0 mass parts of toluene were placed in a closed container and were heated to 70.0° C. and completely dissolved to prepare a monomer solution 1.

| | |
|---|---|
| polymerizable unsaturated group-bearing crystalline polyester 1 | 30.0 mass parts |
| polymerizable unsaturated group-bearing crystalline polyester 2 | 10.0 mass parts |
| organopolysiloxane compound 1 | 25.0 mass parts |
| styrene | 25.0 mass parts |
| methacrylic acid | 10.0 mass parts |
| polyfunctional monomer 1 | 2.0 mass parts |

After this monomer solution 1 had been cooled to 25.0° C., 6.0 mass parts of tertiary-butyl peroxypivalate was admixed as a polymerization initiator followed by introduction into the aqueous medium 1 and exposure for 13 minutes (1 second intermittent, held at 25.0° C.) to ultrasound from a high-output ultrasound homogenizer (VCX-750) to prepare an emulsion of monomer solution 1.

This emulsion was placed in a four-neck flask that had been dried by heating. While the emulsion was stirred at 200 rpm, bubbling with nitrogen was carried out for 30 minutes followed by stirring for 6 hours at 75.0° C. The emulsion was then air-cooled while being stirred to stop the reaction and a dispersion of a coarsely particulate resin was thereby obtained.

The obtained dispersion of a coarsely particulate resin was introduced into a temperature-adjustable stirred tank and was processed by transport at a flow rate of 35 g/min using a pump to a Clear SS5 (M Technique Co., Ltd.) to obtain a dispersion of a finely particulate resin. The conditions for processing this dispersion with the Clear SS5 were 15.7 m/s for the peripheral velocity of the outermost peripheral part of the rotating ring-shaped disk of the Clear SS5 and 1.6 μm for the gap between the rotating ring-shaped disk and the fixed ring-shaped disk. The temperature of the stirred tank was adjusted such that the liquid temperature after processing with the Clear SS5 did not exceed 40° C.

The toluene was separated from the finely particulate resin in the dispersion using a centrifugal separator at 16,500 rpm for 2.5 hours.

After this, a concentrated dispersion of resin fine particles was obtained by removing the supernatant.

This concentrated dispersion of resin fine particles was dispersed in acetone in a stirring apparatus-equipped beaker using a high-output ultrasound homogenizer (VCX-750) to prepare a resin fine particle dispersion 1 having a solids concentration of 10.0 mass %. In each case a portion of the obtained resin fine particle was removed and dried to obtain resins A1.

<Preparation of Resin Fine Particle Dispersions 2 to 9>

Resin fine particle dispersions 2 to 9 were prepared proceeding as in Preparation of Resin Fine Particle Dispersion 1, but changing the monomer as shown in Table 5. In each case a portion of the obtained resin fine particle was removed and dried to obtain resins A2 to A9. Their properties are shown in Table 6.

TABLE 5

| | monomer composition | | | | | | | | |
|---|---|---|---|---|---|---|---|---|---|
| | crystalline polymer D | | crystalline polymer E | | organo polysiloxane compound | | styrene | meth acrylic | poly functional |
| resin fine particle dispersion No. | polymerizable unsaturated group-bearing crystalline polyester No. | amount of addition (mass parts) | polymerizable unsaturated group-bearing crystalline polyester No. | amount of addition (mass parts) | No. | amount of addition (mass parts) | amount of addition (mass parts) | acid amount of addition (mass parts) | monomer 1 amount of addition (mass parts) |
| 1 | 1 | 30.0 | 2 | 10.0 | 1 | 25.0 | 25.0 | 10.0 | 2.0 |
| 2 | 1 | 29.7 | 2 | 9.9 | 1 | 25.0 | 25.0 | 10.0 | 1.0 |
| 3 | 1 | 40.0 | none | — | 1 | 25.0 | 25.0 | 10.0 | 2.0 |
| 4 | 1 | 30.0 | 3 | 10.0 | 1 | 25.0 | 25.0 | 10.0 | 2.0 |
| 5 | 4 | 30.0 | 2 | 10.0 | 1 | 25.0 | 25.0 | 10.0 | 2.0 |
| 6 | 5 | 30.0 | 2 | 10.0 | 1 | 25.0 | 25.0 | 10.0 | 2.0 |
| 7 | 1 | 30.0 | 2 | 10.0 | 2 | 25.0 | 25.0 | 10.0 | 2.0 |
| 8 | 1 | 29.4 | 2 | 9.8 | 1 | 25.0 | 25.0 | 10.0 | 0.0 |
| 9 | 6 | 30.0 | 2 | 10.0 | 1 | 25.0 | 25.0 | 10.0 | 2.0 |

TABLE 6

| resin fine particle dispersion No. | volume-average particle diameter (nm) | resin | matter soluble in acetone at a temperature of 35° C. (mass %) |
|---|---|---|---|
| 1 | 106 | A1 | 21.7 |
| 2 | 113 | A2 | 28.5 |
| 3 | 134 | A3 | 22.0 |
| 4 | 96 | A4 | 23.5 |
| 5 | 129 | A5 | 20.5 |
| 6 | 87 | A6 | 19.8 |
| 7 | 129 | A7 | 22.4 |
| 8 | 144 | A8 | 35.0 |
| 9 | 131 | A9 | 14.2 |

<Preparation of Wax Dispersion 1>

| | |
|---|---|
| dipentaerythritol palmitate ester wax | 17.0 mass parts |
| wax dispersant (copolymer with a peak molecular weight of 8,500 provided by the copolymerization of 50.0 mass parts of styrene, 25.0 mass parts of n-butyl acrylate, and 10.0 mass parts of acrylonitrile in the presence of 15.0 mass parts of polyethylene) | 8.0 mass parts |
| acetone | 75.0 mass parts |

These materials were introduced into a glass beaker (IWAKI Glass) equipped with a stirring blade, and dissolution of the wax in the acetone was carried out by heating the system to 50° C.

The system was then gradually cooled while gently stirring at 50 rpm and was cooled to 25.0° C. over 3 hours to obtain a milky liquid.

This solution was introduced into a heat-resistant container along with 20.0 mass parts of 1 mm glass beads, and dispersion was carried out for 3 hours with a paint shaker (Toyo Seiki Seisaku-sho Ltd.) to obtain a wax dispersion 1.

The wax had a volume-average particle diameter of 150 nm and a melting point of 72.0° C. Its solids concentration was 25.0 mass %.

<Preparation of Colorant Dispersion 1>

| | |
|---|---|
| C.I. Pigment Blue 15:3 | 100.0 mass parts |
| acetone | 150.0 mass parts |
| glass beads (1 mm) | 200.0 mass parts |

These materials were introduced into a heat-resistant glass container; dispersion was carried out for 5 hours with a paint shaker; and the glass beads were removed using a nylon mesh to obtain a colorant dispersion 1. Its solids concentration was 40.0 mass %.

Example 1

| | |
|---|---|
| resin C1 solution (solids = 50.0 mass %) | 173.0 mass parts |
| wax dispersion 1 (solids = 25.0 mass %) | 30.0 mass parts |
| colorant dispersion 1 (solids = 40.0 mass %) | 15.0 mass parts |
| resin fine particle dispersion 1 (solids = 10.0 mass %) | 86.5 mass parts |

were introduced into a beaker and, after adjusting the temperature to 35.0° C., a resin solution 1 was obtained by stirring for 1 minute at 3,000 rpm using a TK Homodisper (Tokushu Kika Kogyo Co., Ltd.).

The following was used for the granulation tank t1 in the apparatus shown in the FIGURE: a pressure-resistant tank fitted in its interior with a stirring apparatus and a thermocouple and fitted on its sides with a jacket for adjusting the temperature.

The resin solution 1 was charged to the granulation tank t1, the temperature of the interior of which had been adjusted to 35.0° C. in advance; the valve V1 and the pressure-regulating valve V2 were closed; and the temperature of the resin solution 1 was adjusted to 35.0° C. while stirring the interior of the granulation tank t1 at a rotation rate of 300 rpm.

The valve V1 was then opened; carbon dioxide (purity=99.99%) was introduced into the granulation tank t1 from the compressed gas cylinder B1; and the valve V1 was closed when the internal pressure reached a gauge pressure of 2.0 MPa (P1). The mass of the introduced carbon dioxide was measured using a mass flow meter at 220.0 mass parts.

The temperature within the container was then confirmed to be 35.0° C., and granulation was performed by stirring for 10 minutes at a stirring rate of 1,000 rpm to prepare a dispersion in which resin solution droplets having a surface coated with the resin fine particle are dispersed in the dispersion medium.

The stirring rate was then dropped to 300 rpm and this dispersion was cooled under a gauge pressure of 2.0 MPa to 23.0° C. at a ramp down rate of 0.5° C./min.

The valve V1 was then opened and carbon dioxide was introduced into the granulation tank t1 from the compressed gas cylinder B1 using the pump P1. At this point the pressure-regulating valve V2 was set to 8.0 MPa and carbon dioxide was additionally flowed through while maintaining the interior pressure (gauge pressure) of the granulation tank t1 at 8.0 MPa. Through this process, carbon dioxide containing organic solvent (primarily acetone) extracted from the droplets after granulation was discharged into the solvent recovery tank t2 and the organic solvent was separated from the carbon dioxide.

After 1 hour the pump P1 was stopped and the valve V1 was closed; the pressure-regulating valve V2 was opened a little at a time; and a resin particle 1, which was trapped by the filter, was recovered by reducing the pressure within the granulation tank t1 to atmospheric pressure.

Examples 2 to 12 and Comparative Examples 1 to 5

Examples 2 to 12 and Comparative Examples 1 to 5 were carried out proceeding as for Example 1, but changing the production conditions in Example 1 as shown in Table 7.

The particle size distribution and the coarse powder percentage were evaluated for the obtained resin particles 1 to 17. The results of the evaluations are given in Table 8.

<Evaluation Methods>

The evaluation of the particle size distribution was carried out by scoring based on the following criteria. In this evaluation, the desirability sequence was A>B>C>D, and the permissible range for the present invention was A to C.

A: the value of D4/D1 is less than 1.15

B: the value of D4/D1 is at least 1.15 and less than 1.20

C: the value of D4/D1 is at least 1.20 and less than 1.25

D: the value of D4/D1 is at least 1.25

The evaluation of the coarse powder percentage was carried out by scoring based on the following criteria. In this evaluation, the desirability sequence was A>B>C>D, and the range in which the effects of the present invention were obtained was A to C.

A: the percentage of particles equal to or larger than 10.1 μm is less than 1.0 volume %

B: the percentage of particles equal to or larger than 10.1 μm is at least 1.0 volume % and less than 1.5 volume %

C: the percentage of particles equal to or larger than 10.1 μm is at least 1.5 volume % and less than 2.0 volume %

D: the percentage of particles equal to or larger than 10.1 μm is at least 2.0 volume %

A visual scoring was performed of the clogging status for the resin fine particles at the filter for recovering the resin particles that was disposed within the granulation tank t1. The results of the evaluation are given in Table 8. In this evaluation, the desirability sequence was A>B>C>D, and the range in which the effects of the present invention were obtained was A to C.

A: clogging is not observed

B: very slight aggregation deriving from the resin fine particles is observed

C: aggregation deriving from the resin fine particles is observed

D: substantial aggregation deriving from the resin fine particles is observed

TABLE 7

| | resin particle No. | resin fine particle dispersion No. | polymerizable unsaturated group-bearing crystalline polyester solution No. used in measurement of the crystal precipitation onset temperature: crystalline polymer D | crystalline polymer E | crystal precipitation onset temperature: Ta (° C.) | Tb (° C.) | step (i): temperature (° C.) | step (i): gauge pressure P1 (MPa) | step (iii): temperature (° C.) | step (ii): gauge pressure P2 (MPa) |
|---|---|---|---|---|---|---|---|---|---|---|
| Example1 | 1 | 1 | 1 | 3 | 27.0 | 18.8 | 35.0 | 2.0 | 23.0 | 8.0 |
| Example2 | 2 | 1 | 1 | 3 | 27.0 | 18.8 | 29.0 | 2.0 | 23.0 | 8.0 |
| Example3 | 3 | 1 | 1 | 3 | 27.0 | 18.8 | 35.0 | 2.0 | 25.0 | 8.0 |
| Example4 | 4 | 1 | 1 | 3 | 27.0 | 18.8 | 35.0 | 2.0 | 20.0 | 8.0 |
| Example5 | 5 | 2 | 1 | 3 | 27.0 | 18.8 | 35.0 | 2.0 | 23.0 | 8.0 |
| Example6 | 6 | 3 | 2 | — | 27.0 | — | 35.0 | 2.0 | 23.0 | 6.5 |
| Example7 | 7 | 4 | 1 | 4 | 27.0 | 23.1 | 35.0 | 2.0 | 25.0 | 8.0 |
| Example8 | 8 | 5 | 5 | 3 | 26.5 | 18.8 | 35.0 | 2.0 | 23.0 | 8.0 |
| Example9 | 9 | 6 | 6 | 3 | 34.1 | 18.8 | 38.0 | 2.0 | 23.0 | 8.0 |
| Example10 | 10 | 1 | 1 | 3 | 32.4 | 23.7 | 38.0 | 5.0 | 27.0 | 10.0 |
| Example11 | 11 | 1 | 1 | 3 | 28.1 | 21.0 | 35.0 | 1.5 | 24.0 | 8.0 |
| Example12 | 12 | 7 | 1 | 3 | 27.0 | 18.8 | 35.0 | 2.0 | 23.0 | 8.0 |
| Comparative Example1 | 13 | 8 | 1 | 3 | 27.0 | 18.8 | 40.0 | 2.0 | 23.0 | 8.0 |
| Comparative Example2 | 14 | 9 | 7 | 3 | 34.1 | 18.8 | 30.0 | 2.0 | 23.0 | 8.0 |
| Comparative Example3 | 15 | 1 | 1 | 3 | 36.3 | 30.4 | 35.0 | 10.0 | 23.0 | 10.0 |
| Comparative Example4 | 16 | 1 | 1 | 3 | 27.0 | 23.7 | 25.0 | 2.0 | 23.0 | 8.0 |
| Comparative Example5 | 17 | 1 | 1 | 3 | 27.0 | 18.8 | 40.0 | 2.0 | 28.0 | 8.0 |

TABLE 8

| | resin particle No. | particle diameter D4 (μm) | particle diameter D1 (μm) | particle size distribution D4/D1 | particle size distribution evaluation | coarse powder percentage volume % | coarse powder percentage evaluation | clogging evaluation |
|---|---|---|---|---|---|---|---|---|
| Example1 | 1 | 5.46 | 5.04 | 1.08 | A | 0.1 | A | A |
| Example2 | 2 | 6.01 | 5.47 | 1.10 | A | 0.9 | A | B |
| Example3 | 3 | 5.92 | 5.02 | 1.18 | B | 1.6 | C | A |
| Example4 | 4 | 5.58 | 5.27 | 1.06 | A | 0.3 | A | A |
| Example5 | 5 | 6.12 | 5.21 | 1.17 | B | 1.2 | B | A |
| Example6 | 6 | 6.44 | 5.21 | 1.24 | C | 0.8 | A | B |
| Example7 | 7 | 6.17 | 5.33 | 1.16 | B | 1.6 | C | A |
| Example8 | 8 | 5.62 | 5.11 | 1.10 | A | 0.7 | A | A |
| Example9 | 9 | 5.92 | 4.92 | 1.20 | C | 0.8 | A | C |
| Example10 | 10 | 6.40 | 5.51 | 1.16 | B | 1.3 | B | A |
| Example11 | 11 | 6.66 | 5.60 | 1.19 | B | 1.4 | B | A |
| Example12 | 12 | 5.75 | 5.27 | 1.09 | A | 0.2 | A | C |
| Comparative Example1 | 13 | 6.47 | 5.10 | 1.27 | D | 2.1 | D | A |
| Comparative Example2 | 14 | 6.31 | 5.22 | 1.21 | C | 1.4 | B | D |
| Comparative Example3 | 15 | 6.69 | 5.44 | 1.23 | C | 2.1 | D | A |
| Comparative Example4 | 16 | 6.52 | 5.39 | 1.21 | C | 1.4 | B | D |
| Comparative Example5 | 17 | 6.80 | 5.81 | 1.17 | B | 2.2 | D | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-069137, filed Mar. 30, 2015, Japanese Patent Application No. 2016-31884, filed Feb. 23, 2016 which are hereby incorporated by reference herein in their entirety.

What is claimed is:

1. A method of producing a toner comprising a toner particle having a core-shell structure that has a core containing a resin and has a shell phase on a surface of the core, the shell phase being derived from a resin fine particle containing a resin A, and the resin A being a resin containing a segment derived from a crystalline polymer D, the method comprising the steps of:

(i) preparing a dispersion in a container, the dispersion being a dispersion of a resin solution droplet dispersed in a dispersion medium, and the resin solution droplet containing the resin, the resin fine particle, and an organic solvent; and (ii) extracting the organic solvent contained in the resin solution droplet into the dispersion medium and removing the organic solvent from the dispersion medium, wherein:

an amount of matter soluble in the organic solvent at a temperature of 35° C. is not more than 30.0 mass % of the resin A, and an amount of matter soluble in the organic solvent at a temperature of 35° C. is at least 90.0 mass % of the crystalline polymer D, a gauge pressure P1 within the container during the preparation of the dispersion in the step (i) is not more than 8.0 MPa, the dispersion is maintained in the step (i) at a temperature higher than a temperature Ta (° C.), and the method further comprises the following step (iii) between the step (i) and the step (ii):

(iii) cooling the dispersion to a temperature lower than the temperature Ta (° C.), (where the temperature Ta (° C.) is a temperature at which—when a crystalline polymer solution prepared by dissolving the crystalline polymer D in the organic solvent is dispersed in the dispersion medium in a container, the container is pressurized to the gauge pressure P1, and the crystalline polymer solution is cooled under the gauge pressure P1—the heat generation accompanying crystal precipitation of the crystalline polymer D contained in the crystalline polymer solution is first observed; in addition, the mixing mass ratio between the crystalline polymer D and the organic solvent is the same as the mixing mass ratio in the step (i) between the crystalline polymer D contained in the resin fine particle and the organic solvent).

2. The method of producing a toner according to claim 1, wherein the dispersion is maintained in the step (i) at a temperature equal to or greater than Ta+3 (° C.).

3. The method of producing a toner according to claim 1, wherein the dispersion is cooled in the step (iii) to a temperature equal to or less than Ta-3 (° C.).

4. The method of producing a toner according to claim 1, wherein the dispersion medium in step (i) is a dispersion medium containing carbon dioxide.

5. The method of producing a toner according to claim 4, wherein the gauge pressure P1 within the container in step (i) is at least 1.0 MPa and not more than 8.0 MPa.

6. The method of producing a toner according to claim 1, wherein, when a gauge pressure in the container in step (ii) is denoted by P2 (MPa), the P2 satisfies the relationship P1≤P2.

7. The method of producing a toner according to claim 1, wherein the step (i) is a step of:

mixing the resin, the resin fine particle, and the organic solvent to prepare a resin solution containing the resin and the resin fine particle, introducing the dispersion medium and the resin solution containing the resin and the resin fine particle into the container, and stirring the interior of the container to prepare a dispersion in which a resin solution droplet having a surface coated with the resin fine particle is dispersed in the dispersion medium.

8. The method of producing a toner according to claim 1, wherein the step (i) is a step of:

mixing the resin and the organic solvent to prepare a resin solution containing the resin, introducing the dispersion medium, the resin fine particle, and the resin solution containing the resin into the container, and stirring the interior of the container to prepare a dispersion in which a resin solution droplet having a surface coated with the resin fine particle is dispersed in the dispersion medium.

9. The method of producing a toner according to claim 1, wherein the resin A is a polymer of a monomer composition containing an organopolysiloxane compound.

10. The method of producing a toner according to claim 9, wherein the organopolysiloxane compound is a compound represented by the following formula (C), and the weight-average molecular weight (Mw) of the compound represented by formula (C) is at least 400 and not more than 2,000 formula (C)

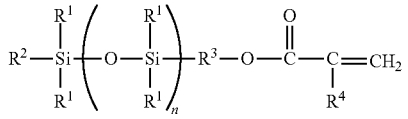

(in formula (C), $R^1$ and $R^2$ each independently represent an alkyl group having 1 to 3 carbons; $R^3$ represents an alkylene group having 1 to 3 carbons; $R^4$ is hydrogen atom or a methyl group; and n is an integer equal to or greater than 2).

11. The method of producing a toner according to claim 1, wherein the crystalline polymer D is a crystalline polyester a1 having polymerizable unsaturated group.

12. The method of producing a toner according to claim 11, wherein an average number of polymerizable unsaturated groups per molecule of the crystalline polyester a1 is at least 1.0 and not more than 3.0.

13. The method of producing a toner according to claim 1, wherein the resin A further contains a segment derived from a crystalline polymer E.

14. The method of producing a toner according to claim 13, wherein:

an amount of matter soluble in the organic solvent at a temperature of 35° C. is at least 90.0 mass % of the crystalline polymer E;

Tb satisfies the relationship Tb<Ta where Tb (° C.) is the temperature at which—when a crystalline polymer solution prepared by dissolving the crystalline polymer E in the organic solvent is dispersed in the dispersion medium in the container, the container is pressurized to the gauge pressure P1, and the crystalline polymer solution is cooled under the gauge pressure P1—the heat generation accompanying crystal precipitation of the crystalline polymer E contained in the crystalline polymer solution is first observed; and the temperature of the dispersion when the dispersion has been cooled in the step (iii) to a temperature lower than the temperature Ta (° C.), is higher than the temperature Tb (° C.).

15. The method of producing a toner according to claim 13, wherein the crystalline polymer E is a crystalline polyester b1 having polymerizable unsaturated group.

16. The method of producing a toner production method according to claim 15, wherein an average number of polymerizable unsaturated groups per molecule of the crystalline polyester b1 is at least 1.0 and not more than 3.0.

17. A method of producing a resin particle having a core-shell structure that has a core containing a resin and has a shell phase on a surface of the core, the shell phase being derived from a resin fine particle containing a resin A, and the resin A being a resin containing a segment derived from a crystalline polymer D, the method comprising the steps of:

(i) preparing a dispersion in a container, the dispersion being a dispersion of a resin solution droplet dispersed in a dispersion medium, and the resin solution droplet containing the resin, the resin fine particle, and an organic solvent; and (ii) extracting the organic solvent contained in the resin solution droplet into the dispersion medium and removing the organic solvent from the dispersion medium, wherein:

an amount of matter soluble in the organic solvent at a temperature of 35° C. is not more than 30.0 mass % of the resin A, and an amount of matter soluble in the organic solvent at a temperature of 35° C. is at least 90.0 mass % of the crystalline polymer D, a gauge pressure P1 within the container during the preparation of the dispersion in the step (i) is not more than 8.0 MPa, the dispersion is maintained in the step (i) at a temperature higher than a temperature Ta (° C.), and the method further comprises the following step (iii) between the step (i) and the step (ii):

(iii) cooling the dispersion to a temperature lower than the temperature Ta (° C.), (where the temperature Ta (° C.) is a temperature at which—when a crystalline polymer solution prepared by dissolving the crystalline polymer D in the organic solvent is dispersed in the dispersion medium in a container, the container is pressurized to the gauge pressure P1, and the crystalline polymer solution is cooled under the gauge pressure P1—the heat generation accompanying crystal precipitation of the crystalline polymer D contained in the crystalline polymer solution is first observed; in addition, the mixing mass ratio between the crystalline polymer D and the organic solvent is the same as the mixing mass ratio in the step (i) between the crystalline polymer D contained in the resin fine particle and the organic solvent).

* * * * *